US008708820B2

(12) United States Patent
Mattice et al.

(10) Patent No.: US 8,708,820 B2
(45) Date of Patent: Apr. 29, 2014

(54) MOVABLE MECHANICAL DISPLAY DEVICES AND METHODS

(75) Inventors: Harold E. Mattice, Gardnerville, NV (US); William R. Wells, Reno, NV (US); Chauncey W. Griswold, Reno, NV (US); Christian E. Gadda, Las Vegas, NV (US); Richard L. Wilder, Sparks, NV (US); James W. Stockdale, Clio, CA (US)

(73) Assignee: IGT, Reno, NV (US)

( * ) Notice: Subject to any disclaimer, the term of this patent is extended or adjusted under 35 U.S.C. 154(b) by 704 days.

(21) Appl. No.: 12/619,308

(22) Filed: Nov. 16, 2009

(65) Prior Publication Data

US 2011/0118013 A1 May 19, 2011

(51) Int. Cl.
*A63F 9/24* (2006.01)

(52) U.S. Cl.
USPC ..... 463/33; 463/16; 463/20; 463/25; 463/29; 463/42

(58) Field of Classification Search
USPC ..... 463/16, 20, 25, 29, 33, 42
See application file for complete search history.

(56) References Cited

U.S. PATENT DOCUMENTS

| | | | | |
|---|---|---|---|---|
| 5,848,932 | A * | 12/1998 | Adams | 463/20 |
| 6,027,115 | A | 2/2000 | Griswold et al. | |
| 7,179,169 | B2 * | 2/2007 | Beaulieu et al. | 463/25 |
| 7,309,284 | B2 | 12/2007 | Griswold et al. | |
| 2003/0195034 | A1 * | 10/2003 | Dunaevsky | 463/20 |
| 2004/0171417 | A1 * | 9/2004 | Beaulieu et al. | 463/20 |
| 2004/0214630 | A1 * | 10/2004 | Mayeroff | 463/20 |
| 2004/0248640 | A1 * | 12/2004 | Kaminkow et al. | 463/20 |
| 2006/0046822 | A1 * | 3/2006 | Kaminkow et al. | 463/16 |
| 2006/0046823 | A1 * | 3/2006 | Kaminkow et al. | 463/16 |
| 2007/0010326 | A1 * | 1/2007 | Seelig et al. | 463/31 |
| 2007/0054723 | A1 | 3/2007 | Mattice et al. | |
| 2007/0054730 | A1 | 3/2007 | Mattice et al. | |
| 2007/0069460 | A1 * | 3/2007 | Hein et al. | 273/142 R |
| 2007/0072668 | A1 * | 3/2007 | Hein et al. | 463/16 |
| 2007/0149281 | A1 | 6/2007 | Gadda et al. | |
| 2008/0020816 | A1 | 1/2008 | Griswold et al. | |
| 2008/0108422 | A1 | 5/2008 | Hedrick et al. | |

* cited by examiner

*Primary Examiner* — William Brewster
*Assistant Examiner* — Ryan Hsu
(74) *Attorney, Agent, or Firm* — Foley & Lardner LLP

(57) ABSTRACT

A gaming machine includes a rotating object that has at least one configurable surface that may be configured electronically. The rotating object may be synchronized with a video display. Configurable surfaces can use bistable materials, electroluminescent materials, LCDs, LEDs, OLEDs, projection, or other techniques. The appearance of the rotating object is changed without physically changing the rotating object.

18 Claims, 18 Drawing Sheets

MOVABLE MECHANICAL DISPLAY DEVICES AND METHODS

BACKGROUND OF THE INVENTION

1. Technical Field

The present invention relates generally to gaming machines and systems, and more specifically gaming machine display systems and devices.

2. Background

Casino gaming machines are well known in the art. Such devices may be embodied as spinning reel slot machines, video slot machines, Video Poker machines or the like. These machines are played by a player making a wager and prompting play. A computer processor for the device selects and displays an outcome. For a slot machine, the processor randomly selects and displays a combination of symbols which combination or combinations define one or more winning outcomes. The player receives an award for each winning outcome and loses their wager for losing outcomes.

It has become popular to provide, for gaming devices such as slot machines, one or more bonus game features. As is known in the art, the player makes their wager and plays a base game obtaining winning and losing outcomes. When a trigger condition is obtained, the bonus feature is enabled. The bonus feature may entail the display of bonus outcome selections where the player makes a selection to reveal a bonus.

Typically, a conventional gaming machine can have various audio and visual display components. Apparatuses and methods for providing displays in gaming machines and/or within a casino are generally well known, and instances of such apparatuses and methods can be found in, for example, U.S. Pat. Nos. 6,135,884; 6,251,014; and 6,503,147, each of which is incorporated herein by reference in its entirety and for all purposes. Such video displays can be used to simulate mechanical gaming reels, whereby all elements of the displayed wheels are controlled and displayed electronically. Alternatively, physical gaming reels may be displayed behind a main display glass or other like viewing element, with the rotation and positioning of these physically present gaming reels being determined and controlled electronically, as is known in the art.

Various methods of gaining and maintaining interest in game play include designing and providing gaming machines with intriguing and different themes, game types, artwork, visual displays, sounds and the like. One attractive feature for many players is the use of a mechanical rotating bonus wheel or a virtual animated bonus wheel in a gaming machine, particularly where the bonus wheel is integrated with game play and/or other pertinent presentations to a game player and instances of such apparatuses and methods can be found in, for example, in U.S. Pat. Nos. 5,788,573, 6,224,483 or in the Wheel of Fortune® Gaming Machines. The bonus wheel tends to be relatively dramatic and attracts players due to the excitement of playing the bonus round. Unfortunately, these types of mechanized wheel-based games can often be inflexible and cannot be reconfigured once the physical values are placed on the mechanized wheel. In order to reconfigure the wheel or the value on the wheels, a technician would have to take the gaming machine apart. This would create downtime for the gaming machine and the gaming machine would not generate any profit during this downtime.

SUMMARY

Various embodiments of the present invention provide rotating displays that are electronically configurable so that they can be reconfigured by software instead of requiring a physical change to the hardware. Displays may use various different types of display elements including bistable elements, electroluminescent elements, LCD, LED, OLED etc. Such elements generally require power, which can be provided to a rotating display through slip rings, or in a contactless manner (optical, thermal, or other electromagnetic transmission). Alternatively, power may be generated from the motion of the rotating display itself. Such displays may be reconfigured for different stages of a game, for bonus rounds, or from one game to another. Rotating displays may be formed in various shapes including a disk which rotates about an axis that passes through its center. Alternative shapes include the shape of a human head, and the shape of a roulette wheel.

Some embodiments include a rotating object that is placed in front of a stationary display. The rotating object may be rotated in a manner that is coordinated with an image displayed by the stationary display. For example, a rotating object may rotate at the same speed as an image rotates on the display. This can give a realistic simulation that the rotating image is physically rotating. An encoder can be used to provide feedback on the position of the rotating object. Both the rotating object and the image can be rotated together based on the same lookup table. Alternatively, the rotation of the rotating object can be synchronized with an image using sensors on the rotating object to detect any misalignment with the rotating image so that adjustment may be made.

According to an embodiment a gaming machine comprises a stationary electronic display housing; and an active electronic display within the electronic display housing, the active electronic display including active display elements on a display surface and conductive leads, the active electronic display physically rotating about an axis of rotation which passes through the display surface, the active electronic display providing an electronically-configurable visual output as it rotates about the axis of rotation.

An example gaming machine comprises a stationary video display; and a rotating object located in front of the display, the rotating object having a surface that has at least one electronically-configurable display area, the electronically-configurable display area obscuring a portion of the video display in a first electronically-selected mode, the electronically-configurable display area not obscuring the portion of the video display in a second electronically-selected mode.

An example method of synchronizing a rotating object and a rotating image on a video display comprises providing an indicator of angular position in the rotating image; detecting the indicator of angular position by at least one optical sensor on the rotating object; and controlling the speed of rotation of the rotating object in response to feedback from the optical sensor such that the speed of rotation of the rotating object is matched to the rate of change of the angular position of the indicator.

An example method of synchronizing a rotating image on a video display and a rotating object located between the video display and a viewer, comprises rotating the rotating object according to an acceleration profile, the acceleration profile indicating a predetermined angular acceleration; and providing a rotating image on the video display, the rotating image rotated according to the acceleration profile so that the rotating image is accelerated with the predetermined angular acceleration.

An example method of synchronizing a rotating object and a rotating image on a video display comprises rotating the rotating object according to a predetermined pattern; monitoring the rotating object using an optical encoder to provide a feedback signal; and controlling the video display in response to the feedback signal so that the rotating image appears to rotate with the rotating object.

Additional objects, features and advantages of the various aspects of the present invention will become apparent from the following description of its preferred embodiments, which description should be taken in conjunction with the accompanying drawings.

DETAILED DESCRIPTION OF EXAMPLE EMBODIMENTS

Figure 1A:
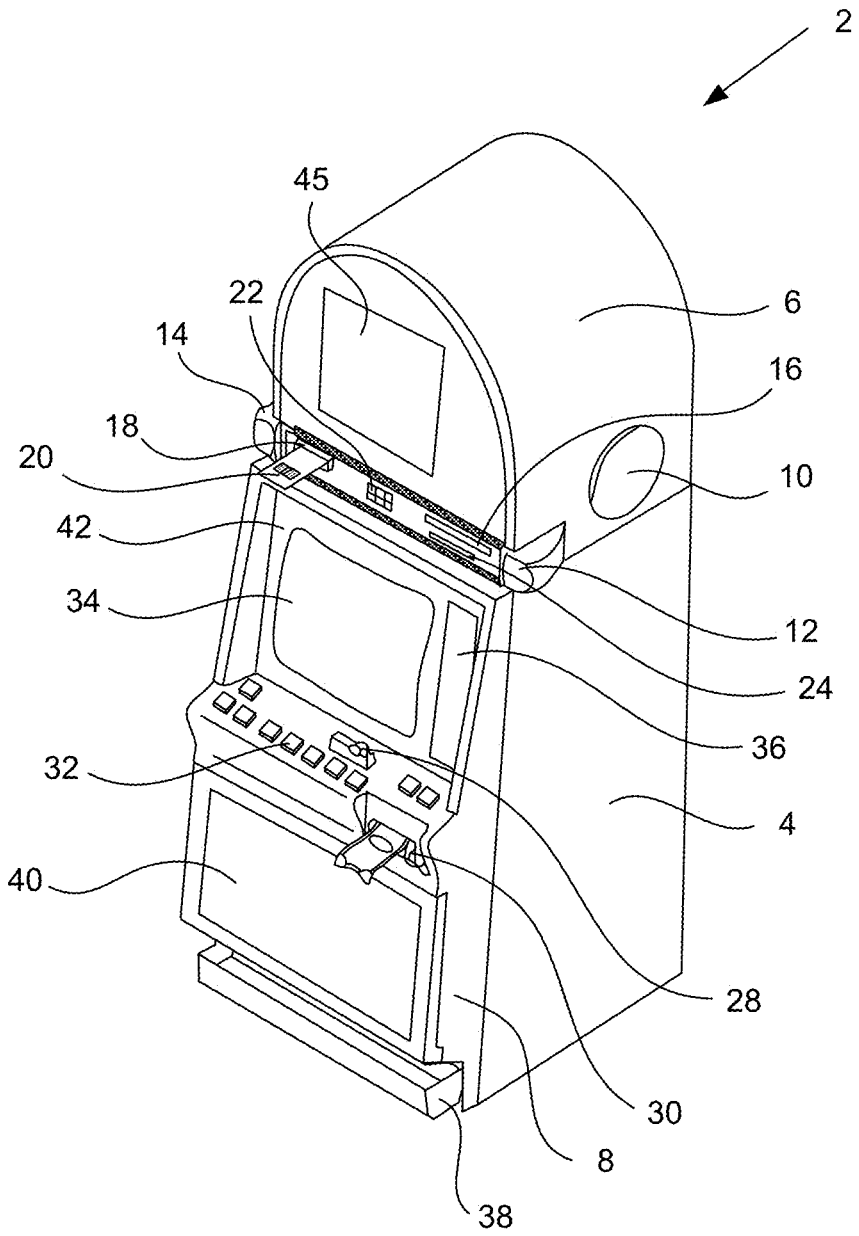
FIG. 1A shows an example of a gaming machine.

Example embodiments will now be described in further detail, and accompanied by the drawings. In the following description, numerous specific details are set forth in order to provide a thorough understanding of example embodiments. It will be apparent, however, to one skilled in the art, that example embodiments may be practiced without some or all of these specific details. In other instances, well known process steps and/or structures have not been described in detail in order to not obscure example embodiments.

One or more different inventions may be described in the present application. Further, for one or more of the invention (s) described herein, numerous embodiments may be described in this patent application, and are presented for illustrative purposes only. The described embodiments are not intended to be limiting in any sense. One or more of the invention(s) may be widely applicable to numerous embodiments, as is readily apparent from the disclosure. These embodiments are described in sufficient detail to enable those skilled in the art to practice one or more of the invention(s), and it is to be understood that other embodiments may be utilized and that structural, logical, software, electrical and other changes may be made without departing from the scope of the one or more of the invention(s). Accordingly, those skilled in the art will recognize that the one or more of the invention(s) may be practiced with various modifications and alterations. Particular features of one or more of the invention (s) may be described with reference to one or more particular embodiments or figures that form a part of the present disclosure, and in which are shown, by way of illustration, specific embodiments of one or more of the invention(s). It should be understood, however, that such features are not limited to usage in the one or more particular embodiments or figures with reference to which they are described. The present disclosure is neither a literal description of all embodiments of one or more of the invention(s) nor a listing of features of one or more of the invention(s) that must be present in all embodiments.

Headings of sections provided in this patent application and the title of this patent application are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required. To the contrary, a variety of optional components are described to illustrate the wide variety of possible embodiments of one or more of the invention (s).

Further, although process steps, method steps, algorithms or the like may be described in a sequential order, such processes, methods and algorithms may be configured to work in alternate orders. In other words, any sequence or order of steps that may be described in this patent application does not, in and of itself, indicate a requirement that the steps be performed in that order. The steps of described processes may be performed in any order practical. Further, some steps may be performed simultaneously despite being described or implied as occurring non-simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to one or more of the invention (s), and does not imply that the illustrated process is preferred.

When a single device or article is described, it will be readily apparent that more than one device/article (whether or not they cooperate) may be used in place of a single device/article. Similarly, where more than one device or article is described (whether or not they cooperate), it will be readily apparent that a single device/article may be used in place of the more than one device or article.

The functionality and/or the features of a device may be alternatively embodied by one or more other devices that are not explicitly described as having such functionality/features. Thus, other embodiments of one or more of the invention(s) need not include the device itself.

As noted above, various aspects of the present application relate to improved gaming machine display systems and display devices.

It will be appreciated that mechanical movable displays can be simulated using a variety of techniques including projection-based techniques and non-projection based techniques. The non-projection based techniques may include, for example, displaying images on flat, bent, curved and/or flexible displays using, for example, bi-stable materials, electroluminescent materials, Liquid Crystal Displays (LCD), Light Emitting Diode (LED) displays, Organic Light Emitting Diode (OLED) displays. Typically, projection-based techniques (e.g., Digital Light Processing) use a projector or projection engine to project images on flat, bent, curved and/or flexible surface. In any case, images can be displayed and/or projected on a stationary or a moving (e.g., rotating) display and/or projection surface. Examples of different techniques are discussed in more detail below.

Example Gaming Machine Embodiments

FIG. 1A shows a perspective view of an example gaming machine 2 in accordance with a specific example of an embodiment. As illustrated in the example of FIG. 1A, machine 2 includes a main cabinet 4, which generally surrounds the machine interior (illustrated, for example, in FIG. 2B) and is viewable by users. The main cabinet includes a main door 8 on the front of the machine, which opens to provide access to the interior of the machine. Attached to the main door are player-input switches or buttons 32, a coin acceptor 28, and a bill validator 30, a coin tray 38, and a belly glass 40. Viewable through the main door is a video display monitor 34 and an information panel 36. The display monitor 34 will typically be a cathode ray tube, high resolution flat-panel LCD, or other conventional electronically controlled video monitor. The information panel 36 may be a back-lit, silk screened glass panel with lettering to indicate general game information including, for example, a game denomination (e.g. $0.25 or $1). The bill validator 30, player-input switches 32, video display monitor 34, and information panel are devices used to play a game on the game machine 2. According to a specific embodiment, the devices may be controlled by code executed by a master gaming controller housed inside the main cabinet 4 of the machine 2. In specific embodiments where it may be required that the code be periodically configured and/or authenticated in a secure manner, example embodiments may be used for accomplishing such tasks.

Many different types of games, including mechanical slot games, video slot games, video poker, video black jack, video pachinko and lottery, may be provided with gaming machines of this invention. In particular, the gaming machine 2 may be operable to provide a play of many different instances of games of chance. The instances may be differentiated according to themes, sounds, graphics, type of game (e.g., slot game vs. card game), denomination, number of paylines, maximum jackpot, progressive or non-progressive, bonus games, etc. The gaming machine 2 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on the gaming machine 2 may be stored as game software on a mass storage device in the gaming machine or may be generated on a remote gaming device but then displayed on the gaming machine. The gaming machine 2 may execute game software, such as but not limited to video streaming software that allows the game to be displayed on the gaming machine. When an instance is stored on the gaming machine 2, it may be loaded from the mass storage device into a RAM for execution. In some cases, after a selection of an instance, the game software that allows the selected instance to be generated may be downloaded from a remote gaming device, such as another gaming machine.

As illustrated in the example of FIG. 1A, the gaming machine 2 includes a top box 6, which sits on top of the main cabinet 4. The top box 6 houses a number of devices, which may be used to add features to a game being played on the gaming machine 2, including speakers 10, 12, 14, a ticket printer 18 which prints bar-coded tickets 20, a key pad 22 for entering player tracking information, a florescent display 16 for displaying player tracking information, a card reader 24 for entering a magnetic striped card containing player tracking information, and a video display device 45. In at least one embodiment, display device 45 may be configured as a movable display, for example, capable of linear and/or rotational movement. The ticket printer 18 may be used to print tickets for a cashless ticketing system. Further, the top box 6 may house different or additional devices not illustrated in FIG. 1A. For example, the top box may include a bonus wheel or a back-lit silk screened panel which may be used to add bonus features to the game being played on the gaming machine. As another example, the top box may include a display for a progressive jackpot offered on the gaming machine. During a game, these devices are controlled and powered, in part, by circuitry (e.g. a master gaming controller) housed within the main cabinet 4 of the machine 2.

It will be appreciated that gaming machine 2 is but one example from a wide range of gaming machine designs relating to example embodiments. For example, not all suitable gaming machines have top boxes or player tracking features. Further, some gaming machines have only a single game display—mechanical or video, while others are designed for bar tables and have displays that face upwards. As another example, a game may be generated on a host computer and may be displayed on a remote terminal or a remote gaming device. The remote gaming device may be connected to the host computer via a network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further a gaming machine or server may include gaming logic for commanding a remote gaming device to render an image from a virtual camera in a 3-D gaming environments stored on the remote gaming device and to display the rendered image on a display located on the remote gaming device. Thus, those of skill in the art will understand that example embodiments, as described below, can be deployed on most any gaming machine now available or hereafter developed.

Some preferred gaming machines of the present assignee are implemented with special features and/or additional circuitry that differentiates them from general-purpose computers (e.g., desktop PC's and laptops). Gaming machines are highly regulated to ensure fairness and, in many cases, gaming machines are operable to dispense monetary awards of multiple millions of dollars. Therefore, to satisfy security and regulatory requirements in a gaming environment, hardware and software architectures may be implemented in gaming machines that differ significantly from those of general-purpose computers. A description of gaming machines relative to general-purpose computing machines and some examples of the additional (or different) components and features found in gaming machines are described below.

At first glance, one might think that adapting PC technologies to the gaming industry would be a simple proposition because both PCs and gaming machines employ microprocessors that control a variety of devices. However, because of such reasons as 1) the regulatory requirements that are placed upon gaming machines, 2) the harsh environment in which gaming machines operate, 3) security requirements and 4) fault tolerance requirements, adapting PC technologies to a gaming machine can be quite difficult. Further, techniques and methods for solving a problem in the PC industry, such as device compatibility and connectivity issues, might not be adequate in the gaming environment. For instance, a fault or a weakness tolerated in a PC, such as security holes in software or frequent crashes, may not be tolerated in a gaming machine because in a gaming machine these faults can lead to a direct loss of funds from the gaming machine, such as stolen cash or loss of revenue when the gaming machine is not operating properly.

For the purposes of illustration, a few differences between PC systems and gaming systems will be described. A first difference between gaming machines and common PC based computers systems is that gaming machines are designed to be state-based systems. In a state-based system, the system stores and maintains its current state in a non-volatile memory, such that, in the event of a power failure or other malfunction the gaming machine will return to its current state when the power is restored. For instance, if a player was shown an award for a game of chance and, before the award could be provided to the player the power failed, the gaming machine, upon the restoration of power, would return to the state where the award is indicated. As anyone who has used a PC, knows, PCs are not state machines and a majority of data is usually lost when a malfunction occurs. This requirement affects the software and hardware design on a gaming machine.

A second important difference between gaming machines and common PC based computer systems is that for regulation purposes, the software on the gaming machine used to generate the game of chance and operate the gaming machine has been designed to be static and monolithic to prevent cheating by the operator of gaming machine. For instance, one solution that has been employed in the gaming industry to prevent cheating and satisfy regulatory requirements has been to manufacture a gaming machine that can use a proprietary processor running instructions to generate the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used by the master gaming controller to operate a device during generation of the game of chance can require a new EPROM to be burnt, approved by the gaming jurisdiction and reinstalled on the gaming machine in the presence of a gaming regulator. Regardless of whether the EPROM solution is used, to gain approval in most gaming jurisdictions, a gaming machine must demonstrate sufficient safeguards that prevent an operator or player of a gaming machine from manipulating hardware and software in a manner that gives them an unfair and some cases an illegal advantage. The gaming machine should have a means to determine if the code it will execute is valid. If the code is not valid, the gaming machine must have a means to prevent the code from being executed. The code validation requirements in the gaming industry affect both hardware and software designs on gaming machines.

A third important difference between gaming machines and common PC based computer systems is the number and kinds of peripheral devices used on a gaming machine are not as great as on PC based computer systems. Traditionally, in the gaming industry, gaming machines have been relatively simple in the sense that the number of peripheral devices and the number of functions the gaming machine has been limited. Further, in operation, the functionality of gaming machines were relatively constant once the gaming machine was deployed, i.e., new peripherals devices and new gaming software were infrequently added to the gaming machine. This differs from a PC where users will go out and buy different combinations of devices and software from different manufacturers and connect them to a PC to suit their needs depending on a desired application. Therefore, the types of devices connected to a PC may vary greatly from user to user depending in their individual requirements and may vary significantly over time.

Although the variety of devices available for a PC may be greater than on a gaming machine, gaming machines still have unique device requirements that differ from a PC, such as device security requirements not usually addressed by PCs. For instance, monetary devices, such as coin dispensers, bill validators and ticket printers and computing devices that are used to govern the input and output of cash to a gaming machine have security requirements that are not typically addressed in PCs. Therefore, many PC techniques and methods developed to facilitate device connectivity and device compatibility do not address the emphasis placed on security in the gaming industry.

To address some of the issues described above, a number of hardware/software components and architectures are utilized in gaming machines that are not typically found in general purpose computing devices, such as PCs. These hardware/software components and architectures, as described below in more detail, include but are not limited to watchdog timers, voltage monitoring systems, state-based software architecture and supporting hardware, specialized communication interfaces, security monitoring and trusted memory.

For example, a watchdog timer is normally used in International Game Technology (IGT) gaming machines to provide a software failure detection mechanism. In a normally operating system, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to allow the operating software to set the timeout interval within a certain range of time. A differentiating feature of the some circuits is that the operating software cannot completely disable the function of the watchdog timer. In other words, the watchdog timer always functions from the time power is applied to the board.

IGT gaming computer platforms preferably use several power supply voltages to operate portions of the computer circuitry. These can be generated in a central power supply or locally on the computer board. If any of these voltages falls out of the tolerance limits of the circuitry they power, unpredictable operation of the computer may result. Though most modern general-purpose computers include voltage monitoring circuitry, these types of circuits only report voltage status to the operating software. Out of tolerance voltages can cause software malfunction, creating a potential uncontrolled condition in the gaming computer. Gaming machines of the present assignee typically have power supplies with tighter voltage margins than that required by the operating circuitry. In addition, the voltage monitoring circuitry implemented in IGT gaming computers typically has two thresholds of control. The first threshold generates a software event that can be detected by the operating software and an error condition generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the computer.

The standard method of operation for IGT slot machine game software is to use a state machine. Different functions of the game (bet, play, result, points in the graphical presentation, etc.) may be defined as a state. When a game moves from one state to another, critical data regarding the game software is stored in a custom non-volatile memory subsystem. This is critical to ensure the player's wager and credits are preserved and to minimize potential disputes in the event of a malfunction on the gaming machine.

In general, the gaming machine does not advance from a first state to a second state until critical information that allows the first state to be reconstructed is stored. This feature allows the game to recover operation to the current state of play in the event of a malfunction, loss of power, etc that occurred just prior to the malfunction. After the state of the gaming machine is restored during the play of a game of chance, game play may resume and the game may be completed in a manner that is no different than if the malfunction had not occurred. Typically, battery backed RAM devices are used to preserve this critical data although other types of non-volatile memory devices may be employed. These memory devices are not used in typical general-purpose computers.

As described in the preceding paragraph, when a malfunction occurs during a game of chance, the gaming machine may be restored to a state in the game of chance just prior to when the malfunction occurred. The restored state may include metering information and graphical information that was displayed on the gaming machine in the state prior to the malfunction. For example, when the malfunction occurs during the play of a card game after the cards have been dealt, the gaming machine may be restored with the cards that were previously displayed as part of the card game. As another example, a bonus game may be triggered during the play of a game of chance where a player is required to make a number of selections on a video display screen. When a malfunction has occurred after the player has made one or more selections, the gaming machine may be restored to a state that shows the graphical presentation at the just prior to the malfunction including an indication of selections that have already been made by the player. In general, the gaming machine may be restored to any state in a plurality of states that occur in the game of chance that occurs while the game of chance is played or to states that occur between the play of a game of chance.

Game history information regarding previous games played such as an amount wagered, the outcome of the game and so forth may also be stored in a non-volatile memory device. The information stored in the non-volatile memory may be detailed enough to reconstruct a portion of the graphical presentation that was previously presented on the gaming machine and the state of the gaming machine (e.g., credits) at the time the game of chance was played. The game history information may be utilized in the event of a dispute. For example, a player may decide that in a previous game of chance that they did not receive credit for an award that they believed they won. The game history information may be used to reconstruct the state of the gaming machine prior, during and/or after the disputed game to demonstrate whether the player was correct or not in their assertion. Further details of a state based gaming system, recovery from malfunctions and game history are described in U.S. Pat. No. 6,804,763, titled "High Performance Battery Backed RAM Interface", U.S. Pat. No. 6,863,608, titled "Frame Capture of Actual Game Play," U.S. application Ser. No. 10/243,104, titled, "Dynamic NV-RAM," and U.S. application Ser. No. 10/758,828, titled, "Frame Capture of Actual Game Play," each of which is incorporated by reference and for all purposes.

Another feature of gaming machines, such as IGT gaming computers, is that they often include unique interfaces, including serial interfaces, to connect to specific subsystems internal and external to the slot machine. The serial devices may have electrical interface requirements that differ from the "standard" EIA 232 serial interfaces provided by general-purpose computers. These interfaces may include EIA 485, EIA 422, Fiber Optic Serial, optically coupled serial interfaces, current loop style serial interfaces, etc. In addition, to conserve serial interfaces internally in the slot machine, serial devices may be connected in a shared, daisy-chain fashion where multiple peripheral devices are connected to a single serial channel.

The serial interfaces may be used to transmit information using communication protocols that are unique to the gaming industry. For example, IGT's Netplex is a proprietary communication protocol used for serial communication between gaming devices. As another example, SAS is a communication protocol used to transmit information, such as metering information, from a gaming machine to a remote device. Often SAS is used in conjunction with a player tracking system.

IGT gaming machines may alternatively be treated as peripheral devices to a casino communication controller and connected in a shared daisy chain fashion to a single serial interface. In both cases, the peripheral devices are preferably assigned device addresses. If so, the serial controller circuitry must implement a method to generate or detect unique device addresses. General-purpose computer serial ports are not able to do this.

Security monitoring circuits detect intrusion into an IGT gaming machine by monitoring security switches attached to access doors in the slot machine cabinet. Preferably, access violations result in suspension of game play and can trigger additional security operations to preserve the current state of game play. These circuits also function when power is off by use of a battery backup. In power-off operation, these circuits continue to monitor the access doors of the slot machine. When power is restored, the gaming machine can determine whether any security violations occurred while power was off, e.g., via software for reading status registers. This can trigger event log entries and further data authentication operations by the slot machine software.

Trusted memory devices and/or trusted memory sources are preferably included in an IGT gaming machine computer to ensure the authenticity of the software that may be stored on less secure memory subsystems, such as mass storage devices. Trusted memory devices and controlling circuitry are typically designed to not allow modification of the code and data stored in the memory device while the memory device is installed in the slot machine. The code and data stored in these devices may include authentication algorithms, random number generators, authentication keys, operating system kernels, etc. The purpose of these trusted memory devices is to provide gaming regulatory authorities a root trusted authority within the computing environment of the slot machine that can be tracked and verified as original. This may be accomplished via removal of the trusted memory device from the slot machine computer and verification of the secure memory device contents is a separate third party verification device. Once the trusted memory device is verified as authentic, and based on the approval of the verification algorithms included in the trusted device, the gaming machine is allowed to verify the authenticity of additional code and data that may be located in the gaming computer assembly, such as code and data stored on hard disk drives. A few details related to trusted memory devices that may be used in example embodiments are described in U.S. Pat. No. 6,685,567, filed Aug. 8, 2001 and titled "Process Verification," and U.S. patent application Ser. No. 11/221,314, titled "Data Pattern Verification in a Gaming Machine Environment," filed Sep. 6, 2005, each of which is incorporated herein by reference in its entirety and for all purposes.

In at least one embodiment, at least a portion of the trusted memory devices/sources may correspond to memory which cannot easily be altered (e.g., "unalterable memory") such as, for example, EPROMS, PROMS, Bios, Extended Bios, and/or other memory sources which are able to be configured, verified, and/or authenticated (e.g., for authenticity) in a secure and controlled manner.

According to a specific implementation, when a trusted information source is in communication with a remote device via a network, the remote device may employ a verification scheme to verify the identity of the trusted information source. For example, the trusted information source and the remote device may exchange information using public and private encryption keys to verify each other's identities. In another example of an embodiment, the remote device and the trusted information source may engage in methods using zero knowledge proofs to authenticate each of their respective identities. Details of zero knowledge proofs that may be used with example embodiments are described in US publication no. 2003/0203756, by Jackson, filed on Apr. 25, 2002 and entitled, "Authentication in a Secure Computerized Gaming System", which is incorporated herein in its entirety and for all purposes.

Gaming devices storing trusted information may utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

Additional details relating to trusted memory devices/sources are described in U.S. patent application Ser. No. 11/078,966, entitled "SECURED VIRTUAL NETWORK IN A GAMING ENVIRONMENT", naming Nguyen et al. as inventors, filed on Mar. 10, 2005, now published as US Patent Application Publication No. 2005/0192099, herein incorporated in its entirety and for all purposes.

Mass storage devices used in a general purpose computer typically allow code and data to be read from and written to the mass storage device. In a gaming machine environment, modification of the gaming code stored on a mass storage device is strictly controlled and would only be allowed under specific maintenance type events with electronic and physical enablers required. Though this level of security could be provided by software, IGT gaming computers that include mass storage devices preferably include hardware level mass storage data protection circuitry that operates at the circuit level to monitor attempts to modify data on the mass storage device and will generate both software and hardware error triggers should a data modification be attempted without the proper electronic and physical enablers being present. Details using a mass storage device that may be used with example embodiments are described, for example, in U.S. Pat. No. 6,149,522, herein incorporated by reference in its entirety for all purposes.

Returning to the example of FIG. 1A, when a user wishes to play the gaming machine 2, he or she inserts cash through the coin acceptor 28 or bill validator 30. Additionally, the bill validator may accept a printed ticket voucher which may be accepted by the bill validator 30 as indicia of credit when a cashless ticketing system is used. At the start of the game, the player may enter playing tracking information using the card reader 24, the keypad 22, and the florescent display 16. Further, other game preferences of the player playing the game may be read from a card inserted into the card reader. During the game, the player views game information using the video display 34. Other game and prize information may also be displayed in the video display device 45 located in the top box.

During the course of a game, a player may be required to make a number of decisions, which affect the outcome of the game. For example, a player may vary his or her wager on a particular game, select a prize for a particular game selected from a prize server, or make game decisions which affect the outcome of a particular game. The player may make these choices using the player-input switches 32, the video display screen 34 or using some other device which enables a player to input information into the gaming machine. In some embodiments, the player may be able to access various game services such as concierge services and entertainment content services using the video display screen 34 and one more input devices.

During certain game events, the gaming machine 2 may display visual and auditory effects that can be perceived by the player. These effects add to the excitement of a game, which makes a player more likely to continue playing. Auditory effects include various sounds that are projected by the speakers 10, 12, 14. Visual effects include flashing lights, strobing lights or other patterns displayed from lights on the gaming machine 2 or from lights behind the belly glass 40. After the player has completed a game, the player may receive game tokens from the coin tray 38 or the ticket 20 from the printer 18, which may be used for further games or to redeem a prize. Further, the player may receive a ticket 20 for food, merchandise, or games from the printer 18.

Figure 1B:
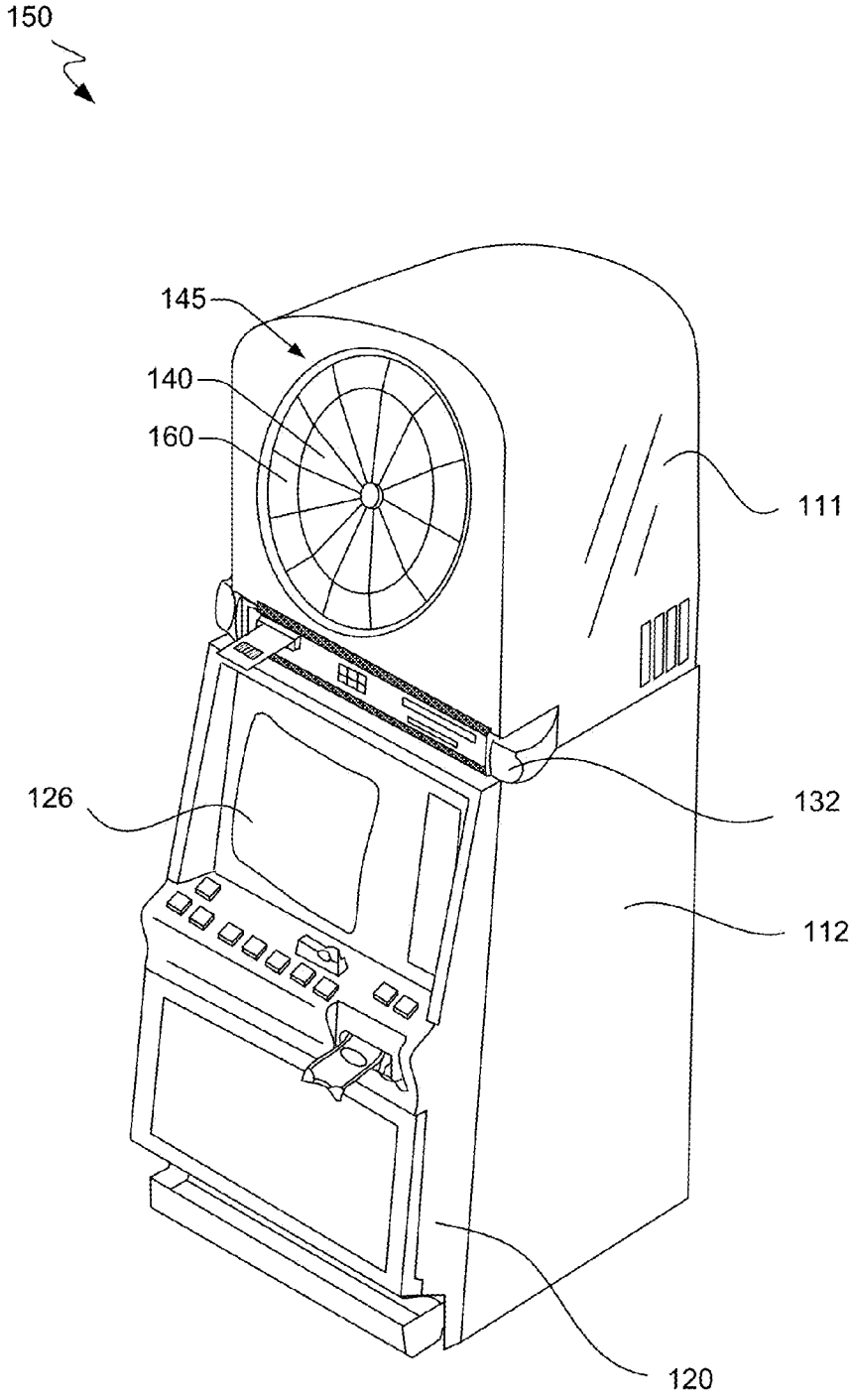
FIG. 1B shows another example of a gaming machine.

FIG. 1B shows a perspective view of an alternate embodiment of a gaming machine 150. As shown in the example of FIG. 1B, gaming machine 150 also includes a top box 111 and a main cabinet 112, one or both of which can comprise an exterior housing arranged to contain a number of internal gaming machine components. Many features can also be the same or similar to corresponding features in gaming machine 2 (FIG. 1A), such as a main door 120, a primary video display monitor 126 and one or more speakers 132.

As illustrated in the embodiment of FIG. 1B, top box 111 includes a movable display device 145 generally having the appearance of a rotatable mechanical wheel. In one embodiment, the display device 145 may include independently movable portions (e.g., 140, 160). In other embodiments, the display devices 145 may give the appearance of a single rotating wheel. For example, in one embodiment, the display portion 160 has the ability to rotate around display portion 140. As illustrated in the embodiment of FIG. 1B, the movable display device 145 may be operable to rotate around an axis that is substantially horizontal with respect to an ordinary upright position of the gaming machine 150. The direction of rotation may include clockwise, counter-clockwise or combinations thereof.

In an alternate embodiment, the movable display device may generally have a different appearance. In at least one embodiment, a movable display device may be operable to rotate around an axis that is substantially horizontal with respect to an ordinary upright position of the gaming machine. In at least one other embodiment, the spherical-appearing movable display device may be operable to rotate around an axis that is substantially vertical with respect to an ordinary upright position of the gaming machine. In other embodiments, the axis of rotation may vary, depending upon desired criteria.

For example, an angle of the axis of rotation relative to a front viewing surface of the gaming machine may be varied. For instance, when mounted in a top box, the axis may be tilted down to change a viewing angle of the rotatable object relative to a player playing at the gaming machine 10.

Top box 111 may also comprise a bonus indicator or light, which can be used to indicate whenever the gaming machine enters a bonus mode. Accordingly, it will be readily appreciated that this indicator can be a light, a series of lights, an arrow or other pointer, and/or any other convenient bonus indicator.

As shown in the particular embodiment illustrated, top box 111 may include various components to facilitate the play of a bonus game associated with a main game played on gaming machine 150. In one embodiment, an outcome or series of outcomes on a main game or games played on gaming machine 150 can result in the ability of a player to play in a bonus game on the top box 111 of the gaming machine. Other ways of accessing such a bonus game might also be possible, as desired by a given gaming operator. In one embodiment, the play of the bonus game involves a virtual rotation of images on the inner video display and a physical rotation of the rotatable object.

Figure 2A:
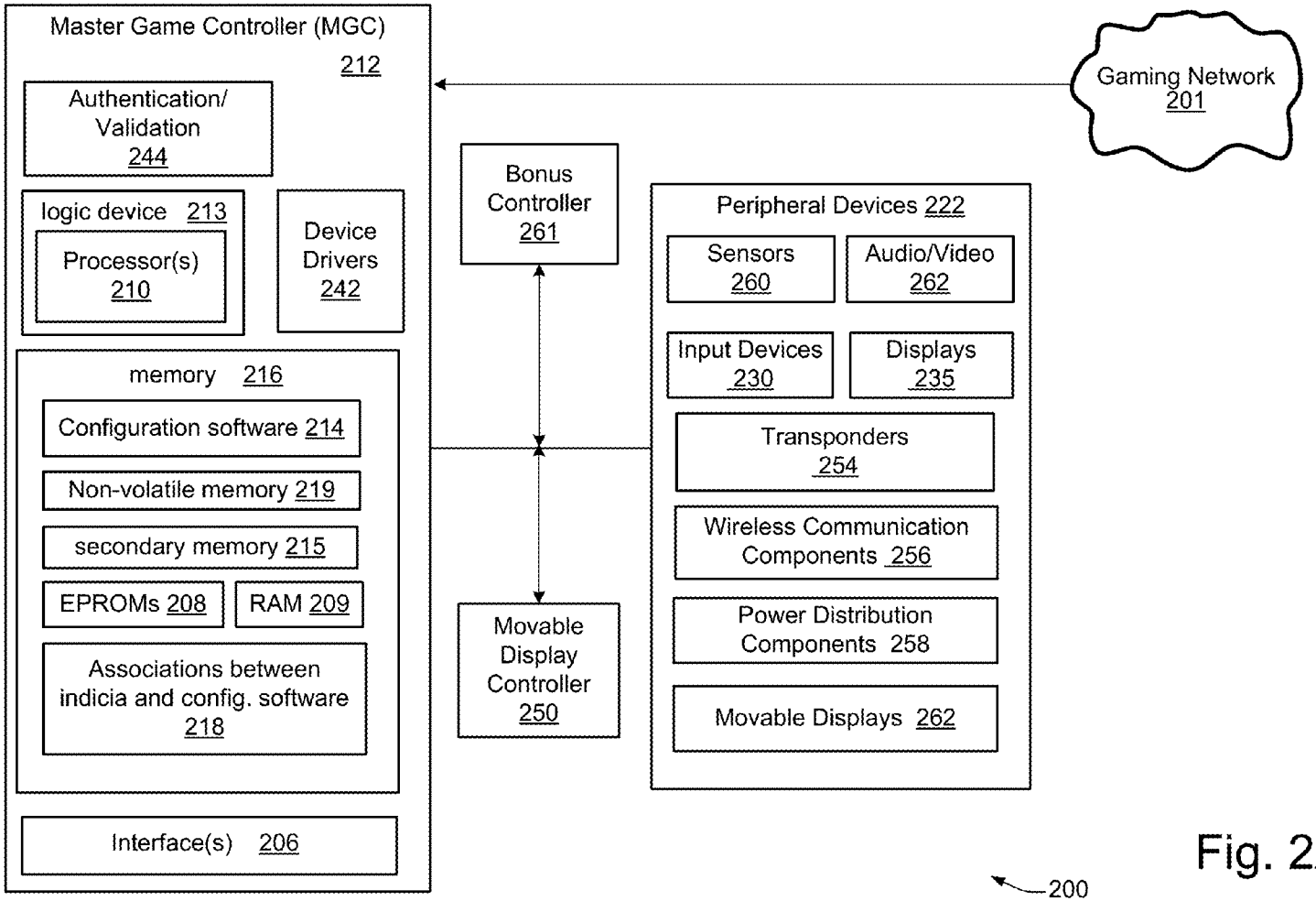
FIG. 2A shows a simplified block diagram of a gaming machine embodiment.

FIG. 2A is a simplified block diagram of an example gaming machine 200. As illustrated in the embodiment of FIG. 2A, gaming machine 200 includes at least one processor 210, at least one interface 206, and memory 216.

In one implementation, processor 210 and master game controller 212 are included in a logic device 213 enclosed in a logic device housing. The processor 210 may include any conventional processor or logic device configured to execute software allowing various configuration and reconfiguration tasks such as, for example: a) communicating with a remote source via communication interface 206, such as a server that stores authentication information or games; b) converting signals read by an interface to a format corresponding to that used by software or memory in the gaming machine; c) accessing memory to configure or reconfigure game parameters in the memory according to indicia read from the device; d) communicating with interfaces, various peripheral devices 222 and/or I/O devices; e) operating peripheral devices 222 such as, for example, card readers, paper ticket readers, etc.; f) operating various I/O devices such as, for example, displays 235, input devices 230; etc. For instance, the processor 210 may send messages including game play information to the displays 235 to inform players of cards dealt, wagering information, and/or other desired information.

The gaming machine 200 also includes memory 216 which may include, for example, volatile memory (e.g., RAM 209), non-volatile memory 219 (e.g., disk memory, FLASH memory, EPROMs, etc.), unalterable memory (e.g., EPROMs 208), etc. The memory may be configured or designed to store, for example: 1) configuration software 214 such as all the parameters and settings for a game playable on the gaming machine; 2) associations 218 between configuration indicia read from a device with one or more parameters and settings; 3) communication protocols allowing the processor 210 to communicate with peripheral devices 222 and I/O devices; 4) a secondary memory storage device 215 such as a non-volatile memory device, configured to store gaming software related information (the gaming software related information and memory may be used to store various audio files and games not currently being used and invoked in a configuration or reconfiguration); 5) communication transport protocols (such as, for example, TCP/IP, USB, Firewire, IEEE1394, Bluetooth, IEEE 802.11x (IEEE 802.11 standards), hiperlan/2, HomeRF, etc.) for allowing the gaming machine to communicate with local and non-local devices using such protocols; etc. In one implementation, the master game controller 212 communicates using a serial communication protocol. A few examples of serial communication protocols that may be used to communicate with the master game controller include but are not limited to USB, RS-232 and Netplex (a proprietary protocol developed by IGT, Reno, Nev.).

A plurality of device drivers 242 may be stored in memory 216. Example of different types of device drivers may include device drivers for gaming machine components, device drivers for peripheral components 222, etc. Typically, the device drivers 242 utilize a communication protocol of some type that enables communication with a particular physical device. The device driver abstracts the hardware implementation of a device. For example, a device drive may be written for each type of card reader that may be potentially connected to the gaming machine. Examples of communication protocols used to implement the device drivers include Netplex, USB, Serial, Ethernet, Firewire, I/O debouncer, direct memory map, serial, PCI, parallel, RF, Bluetooth™, near-field communications (e.g., using near-field magnetics), 802.11 (WiFi), etc. Netplex is a proprietary IGT standard while the others are open standards. According to a specific embodiment, when one type of a particular device is exchanged for another type of the particular device, a new device driver may be loaded from the memory 216 by the processor 210 to allow communication with the device. For instance, one type of card reader in gaming machine 200 may be replaced with a second type of card reader where device drivers for both card readers are stored in the memory 216.

In some embodiments, the software units stored in the memory 216 may be upgraded as needed. For instance, when the memory 216 is a hard drive, new games, game options, various new parameters, new settings for existing parameters, new settings for new parameters, device drivers, and new communication protocols may be uploaded to the memory from the master game controller 212 or from some other external device. As another example, when the memory 216 includes a CD/DVD drive including a CD/DVD designed or configured to store game options, parameters, and settings, the software stored in the memory may be upgraded by replacing a first CD/DVD with a second CD/DVD. In yet another example, when the memory 216 uses one or more flash memory 219 or EPROM 208 units designed or configured to store games, game options, parameters, settings, the software stored in the flash and/or EPROM memory units may be upgraded by replacing one or more memory units with new memory units which include the upgraded software. In another embodiment, one or more of the memory devices, such as the hard-drive, may be employed in a game software download process from a remote software server.

In some embodiments, the gaming machine 200 may also include various authentication and/or validation components 244 which may be used for authenticating/validating specified gaming machine components such as, for example, hardware components, software components, firmware components, information stored in the gaming machine memory 216, etc. Examples of various authentication and/or validation components are described in U.S. Pat. No. 6,620,047, entitled, "ELECTRONIC GAMING APPARATUS HAVING AUTHENTICATION DATA SETS," incorporated herein by reference in its entirety for all purposes.

In specific embodiments where the gaming machine includes a "bonus" game, gaming machine 200 may also include a bonus controller 261 for controlling aspects relating to the bonus game.

As illustrated in the embodiment of FIG. 2A, the gaming machine 200 also includes a movable display controller 250 which may be configured or designed to control various aspects relating to movable displays 262 such as, for example: images, text, and/or other content displayed on one or more of the movable displays; motion control of the movable displays; etc. In at least one implementation, the movable display controller 250 may perform specific operations in response to instructions or signals received from a master gaming controller 212 and/or bonus controller 261. In alternate embodiments, the content and/or movement of the movable displays 262 may be directly controlled by the master gaming controller 212, bonus controller 261, a remote server, an external device, or any combination thereof.

Peripheral devices 222 may also include several device interfaces such as, for example: transponders 254, wire/wireless power distribution components 258, input device(s) 230, sensors 260, audio and/or video devices (e.g., cameras, speakers, etc.), transponders 254, wireless communication components 256, wireless power components 258, etc.

Sensors 260 may include, for example, optical sensors, pressure sensors, RF sensors, Infrared sensors, image sensors, thermal sensors, biometric sensors, etc. Such sensors may be used for a variety of functions such as, for example detecting the presence and/or identity of various persons (e.g., players, casino employees, etc.), devices (e.g., mobile devices), and/or systems within a predetermined proximity to the gaming machine. In one implementation, at least a portion of the sensors 260 and/or input devices 230 may be implemented in the form of touch keys selected from a wide variety of commercially available touch keys used to provide electrical control signals. Alternatively, some of the touch keys may be implemented in another form which are touch sensors such as those provided by a touchscreen display. For example, in at least one implementation, the gaming machine player displays and/or mobile device displays may include input functionality for allowing players to provide desired information (e.g., game play instructions and/or other input) to the gaming machine, game table and/or other gaming system components using the touch keys and/or other player control sensors/buttons. Additionally, such input functionality may also be used for allowing players to provide input to other devices in the casino gaming network (such as, for example, player tracking systems, side wagering systems, etc.)

Wireless communication components 256 may include one or more communication interfaces having different architectures and utilizing a variety of protocols such as, for example, 802.11 (WiFi), 802.15 (including Bluetooth™), 802.16 (WiMax), 802.22, Cellular standards such as CDMA, CDMA2000, WCDMA, Radio Frequency (e.g., RFID), Infrared, Near Field Magnetic communication protocols, etc. The communication links may transmit electrical, electromagnetic or optical signals which carry digital data streams or analog signals representing various types of information.

Power distribution components 258 may include, for example, components or devices which are operable for providing wired or wireless power to other devices. For example, in one implementation, the power distribution components 258 may include a magnetic induction system which is adapted to provide wireless power to one or more mobile devices near the gaming machine. In one implementation, a mobile device docking region may be provided which includes a power distribution component that is able to recharge a mobile device without requiring metal-to-metal contact.

In other embodiments (not shown) other peripheral devices include: player tracking devices, card readers, bill validator/paper ticket readers, etc. Such devices may each comprise resources for handling and processing configuration indicia such as a microcontroller that converts voltage levels for one or more scanning devices to signals provided to processor 210. In one embodiment, application software for interfacing with peripheral devices 222 may store instructions (such as, for example, how to read indicia from a portable device) in a memory device such as, for example, non-volatile memory, hard drive or a flash memory.

In at least one implementation, the gaming machine may include card readers such as used with credit cards, or other identification code reading devices to allow or require player identification in connection with play of the card game and associated recording of game action. Such a user identification interface can be implemented in the form of a variety of magnetic card readers commercially available for reading a user-specific identification information. The user-specific information can be provided on specially constructed magnetic cards issued by a casino, or magnetically coded credit cards or debit cards frequently used with national credit organizations such as VISA™, MASTERCARD™, banks and/or other institutions.

The gaming machine may include other types of participant identification mechanisms which may use a fingerprint image, eye blood vessel image reader, or other suitable biological information to confirm identity of the user. Still further it is possible to provide such participant identification information by having the dealer manually code in the information in response to the player indicating his or her code name or real name. Such additional identification could also be used to confirm credit use of a smart card, transponder, and/or player's mobile device.

It will be apparent to those skilled in the art that other memory types, including various computer readable media, may be used for storing and executing program instructions pertaining to the operation EGMs described herein. Because such information and program instructions may be employed to implement the systems/methods described herein, example embodiments may relate to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media such as floptical disks; and hardware devices that are specially configured to store and perform program instructions, such as read-only memory devices (ROM) and random access memory (RAM). Example embodiments may also be embodied in a carrier wave traveling over an appropriate medium such as airwaves, optical lines, electric lines, etc. Examples of program instructions include both machine code, such as produced by a compiler, and files including higher level code that may be executed by the computer using an interpreter.

Additional details about other gaming machine architectures, features and/or components are described, for example, in U.S. patent application Ser. No. 10/040,239, entitled, "GAME DEVELOPMENT ARCHITECTURE THAT DECOUPLES THE GAME LOGIC FROM THE GRAPHICS LOGIC," and published on Apr. 24, 2003 as U.S. Patent Publication No. 20030078103, incorporated herein by reference in its entirety for all purposes.

Figure 2B:
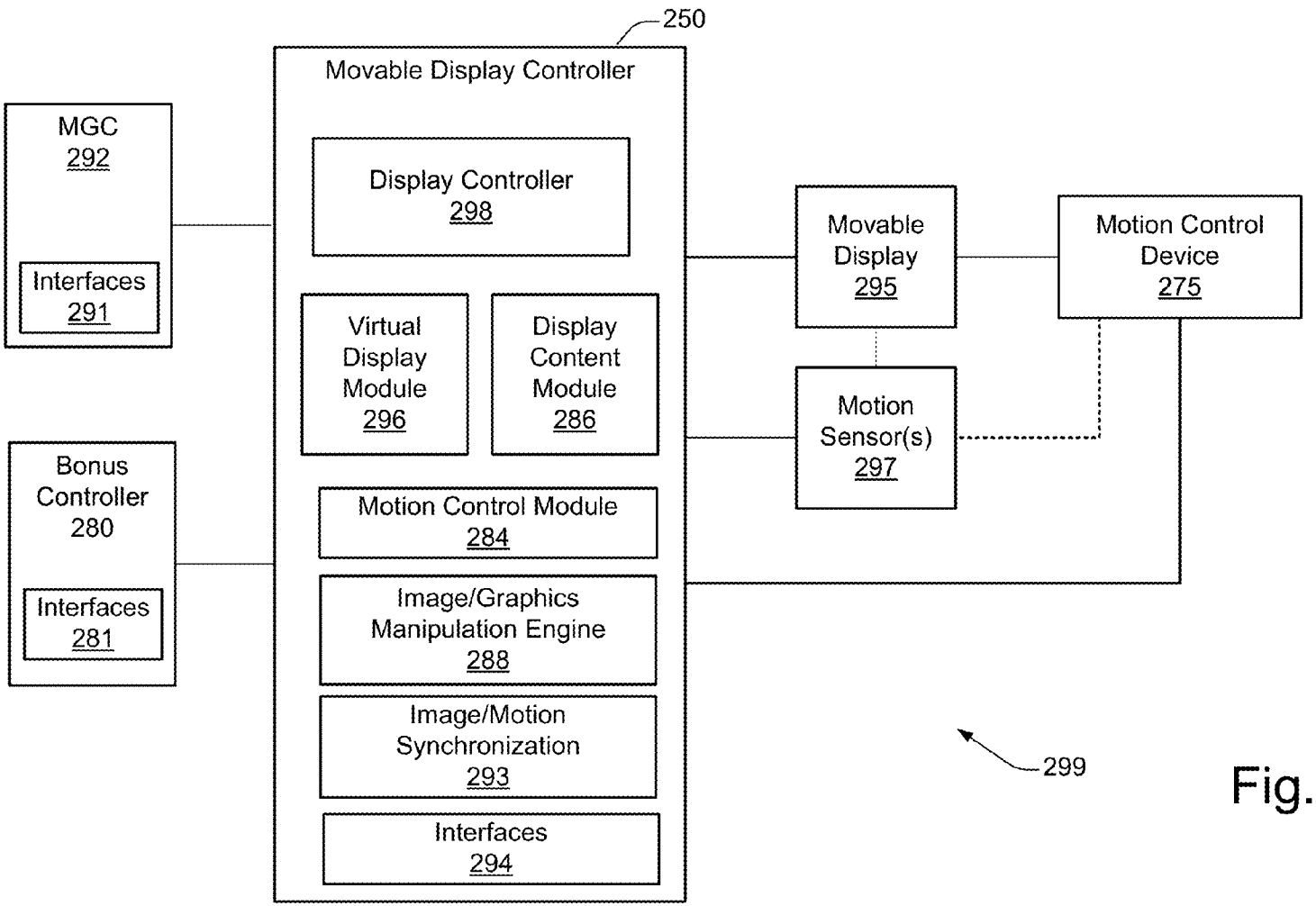
FIG. 2B shows a simplified block diagram of a gaming machine embodiment that includes a movable display.

FIG. 2B shows a block diagram of a specific embodiment of various gaming machine components which may be used for implementing aspects of the movable display technique of the present invention. In at least one implementation, the movable display controller 250 and its associated components may perform specific operations in response to instructions or signals received from master gaming controller 292 and/or bonus controller 280.

According to a specific embodiment, movable display controller 250 may be adapted to provide content to one or more movable displays 295. For example, as illustrated in FIG. 2B, movable display controller 250 may include one or more display controller 298 for providing and controlling content which is to be displayed on one or more of the movable displays 295. According to specific embodiments, each display controller may be associated with a respective movable display, or at least one display controller may be associated with multiple movable displays. According to a specific implementation, the display controller(s) may be implemented using at least one display adapter and/or video card that is compatible with the type of display(s) to be controlled. For example, in one implementation, display controller 298 may be operable for displaying content on movable display 295. In at least one embodiment, display controller 298 may be adapted to independently display desired content on a plurality of different movable displays.

According to specific embodiments, at least one image/graphics manipulation engine 288 may be provided. In one embodiment, the image/graphics manipulation engine 288 may include functionality for manipulating and/or modifying content (e.g., images, objects, text, graphics, etc.) to be displayed on the movable display. For example, in one embodiment, the image/graphics manipulation engine 288 may include image correction functionality for enabling content to be projected on the movable display without observable distortion effects. Such distortion effects may typically occur, for example, in a variety of situations where the angle of incidence (e.g., of the light from the projection source upon the display surface) may differ across different portions of the display surface.

For example, in specific embodiments where the movable display has a curved display surface, distortion effects involving image compaction (e.g., shortening) and/or image elongation (e.g., stretching) may be observed at various regions of the display surface. In at least one embodiment, the image/graphics manipulation engine 288 may be operable to perform one or more of the following operations: detect inconsistencies and/or irregularities (including curvatures) of the display surface; determine the relative locations and positions of the projection source(s) and display surface(s); determine the degree and/or type of graphical manipulations to be performed (e.g., on the content to be projected) in order to partially and/or substantially compensate for any distortion effects caused by the display surface inconsistencies/irregularities; perform one or more manipulations on the content to be displayed in order and enable the content to be projected onto the display surface without significant or substantially observable distortion effects, etc. Additionally, in at least some embodiments, the image/graphics manipulation engine 288 may be operable to implement its functionality in real-time (or substantially real-time) so that the content is timely displayed on the movable display in coordination with other activities (e.g., game play activities, bonus activities, etc.) being performed at the gaming machine.

According to one embodiment, different types of display content may be displayed on movable display 295. For example, a first portion of display 295 may be used to display videos or images, while a second portion of display 295 may be used to display text. Further, in at least one embodiment, multiple movable displays may be used to form a virtual display for displaying content which may span across multiple displays.

Display information and/or signals may be provided from a display controller to a movable display using one or more standardized display protocols such as, for example: VGA, DCI, PCI, AGP, PCI Express, PCI-X, etc. Of course, other display protocols such as, for example, non-standardized display protocols, proprietary display protocols, etc. may also be used, if desired. In at least one implementation, the movable display controller 250 may include a display content module 286 configured or designed to provide display content information to selected display controllers. The display content module 286 may include memory for storing at least a portion of the display content information. In at least one embodiment, all or portions of the display content may be stored at one or more network locations and/or RF links. The display content module may also be adapted to receive display content information from different sources such as, for example, from bonus controller 280 and/or from remote sources. Such display content information may be received via one or more interfaces such as, for example, master gaming controller interfaces 291, bonus controller interfaces 281, and/or movable display controller interfaces 294. In at least one implementation, one or more of these interfaces may be configured or designed to provide a communication path for exchanging information with external devices such as, for example, other gaming machines, other bonus controllers, gaming servers, content providers, external displays, peripheral devices, etc.

As illustrated in the embodiment of FIG. 2B, movable display controller 250 may also include a virtual display module 296 configured or designed to control portions of the display content in order to enhance or modify the content to be displayed on the movable display 295. For example, the virtual display module 296 may include functionality for implementing a virtual mechanical display device such as a wheel or globe.

Another feature which may be provided by the movable display controller 250 is the ability to control the movement or motion of one or more movable displays. For example, as illustrated in FIG. 2B, movable display controller 250 may include a motion control module 284 for controlling the movement or motion of movable display 295. In this example, the movement of display 295 may be achieved using at least one motion control device 275. According to different embodiments, each motion control device may be adapted to control the movement of one or more displays.

According to a specific embodiment, the motion control device 275 may be implemented using any number of different types of motion control devices (either open or closed loop) for translating the movable displays. These types of motion control devices may include, but are not limited to, friction drive devices, ballscrew and jacknut devices, belt and pulley devices, electromagnetic linear types of motion control devices, cam and follower devices, gear drives, leadscrews, etc. The drivers for such systems may include, for example, stepper motors, server motors, gear motors, pneumatic drivers, etc. Each of the different types of drivers may be implemented either with or without mechanical and electromechanical encoders and other feedback technologies, as desired.

As illustrated in the embodiment of FIG. 2B, one or more motion sensing device(s) 297 may be provided to detect and/or monitor motion(s) or movement(s) of the movable display 295. For example, in one embodiment, position sensing devices (such as, for example, microswitches) may be used to monitor the positions of the movable display 295 and to provide feedback to the motion control device 275, motion control module 284, and/or other components of the movable display controller 250.

According to specific embodiments, the motion sensor(s) 297 may be adapted to continually or periodically monitor the movable display 295 for any movement activity. If movement of the movable display is detected, the motion sensor(s) 297 may be operable to identify movement activity, and to determine a real-time (or substantially real-time) estimate of the directional vector(s), velocity, displacement, and/or acceleration/deceleration of display movement. In at least one embodiment, such determining may include taking periodic measurements of velocity, displacement, and/or acceleration parameters associated with one or more selected regions of the display. In some embodiments, such determining may include taking periodic measurements of velocity, displacement, and/or acceleration/deceleration parameters associated with one or more of the motion control device(s) used for imparting motion to the display.

In at least one embodiment, the motion sensor(s) 297 may be operable to generate display motion data which, for example, may be used to describe current (e.g., real-time), past and/or future motion-related characteristics of the movable display 295. For example, in one embodiment, motion sensor(s) 297 may be operable to determine: (1) a current or real-time rotational velocity of the movable display (if any), and (2) a current or real-time rotational acceleration/deceleration of the movable display (if any).

According to specific embodiments, rotational movement of the movable display may be measured and/or expressed using a variety of different parameters, such as, for example, one or more of the following (and/or combination thereof):

rotational velocity;

rotational speed (e.g., cycles per second, revolutions per second, revolutions per minute, etc.);

periodic speed (e.g., seconds per cycle, seconds per rotation, etc.);

angular speed (e.g., degrees per second, radians per second, etc);

radial frequency;

tangential speed; etc.

Using the rotational velocity information and rotational acceleration/deceleration information, the motion sensor 297 may be operable to generate display motion data which includes information relating to motion-related characteristics of the movable display 295 such as, for example, one or more of the following: the movable display's current velocity, current acceleration/deceleration, expected future velocities for a given time interval T, expected future acceleration/deceleration for a given time interval T, etc.

In at least one alternate embodiment, the motion sensor(s) 297 may be operable to continuously or periodically determine the relative position and/or orientation of the movable display. For example, in one embodiment, the motion sensor (s) 297 may be operable to determine the relative position of the movable display every $1/30^{th}$ of a second. Using the real-time display position information, the motion sensor 297 may be operable to generate display motion data which includes information relating to the current position of the movable display and/or expected future positions of the movable display.

Various types of moving displays may be used according to embodiments of the present invention. Such moving displays may include projector based displays, displays using bi-stable materials, displays using electroluminescent components, Liquid Crystal Displays (LCDs) or any other suitable display. Examples of projector based displays are described in US Patent Application Publication No. 2007/0149281, which application is hereby incorporated by reference in its entirety. One advantage of a projector based display is that the display itself may be very simple because the image is generated by a projector that is physically remote from the display. Thus, the display may be formed by any suitable surface and does not generally need any electronics or active elements. This makes moving such a display relatively easy because communication and power do not have to be provided to the display during movement (though they are provided to the projector which is generally stationary). Non-projector displays generally have some active elements in the display itself and may be considered to be active displays. The term "active electronic display" is used here to refer to any type of display that includes active elements that are electronically controlled, such as displays using bi-stable elements, electroluminescent elements, or liquid crystal elements. Such displays generally include connections to the active elements in the form of conductive leads.

Bi-Stable Material Displays

One simple type of active electronic display is based on a bi-stable material such as an electronic paper. Examples of bi-stable materials and their use may be found in US Patent Application Publication No. 2007/0054730. Embodiments of the present invention relate to a bi-stable material providing configurable surfaces on a wheel of a gaming machine, such as a slot machine. It can be said that the pixels of the material are bi-stable, because the state of each pixel can be maintained without a constant supply of power. The information displayed on the configurable surface can be downloaded from a data source and changed as desired. While the term "active electronic display" is used to include displays using bi-stable materials, it will be understood that such displays may not require power at all times that content is displayed. Thus, display elements may be considered active even though they are only electrically active at certain times.

Embodiments of the present invention provide for configurable regions defined on the configurable surface. Each region is configurable to display one or more symbols of a game of chance, such as bonus amounts or other indicia. Such indicia can be electronically downloaded from a gaming server or other gaming machine to the gaming machine (slot machine). A controller in the slot machine is operatively coupled to update the configurable regions to display the downloaded indicia. In this way, a game provided on the slot machine can be changed as desired. Because of the bi-stable nature of the configurable surface, the active electronic display only needs to have power when the displayed information is updated. Otherwise, the power can be switched off. Because of the electronic download and update capabilities of the bi-stable display, alteration or replacement of the physical display is not necessary to update or change the game.

Electronic paper is one possible implementation of a bi-stable material used to form a display having surfaces with configurable regions, in accordance with embodiments of the present invention. Electronic paper can be disposed on a disc or wheel to form a configurable rotating display, as described herein. One suitable electronic paper for use with embodiments of the present invention is electronic paper display technology incorporating electronic ink, manufactured by E Ink Corp.

As known to those skilled in the art, electronic paper possesses a paper-like high contrast appearance, low power consumption, and a thin, light form. Electronic paper gives the viewer the experience of reading from paper, while having the capability of updatable information. Electronic ink in the paper carries a charge enabling it to be updated electronically. Electronic ink is a reflective technology that requires no front or backlight, is viewable under a wide range of lighting conditions, including direct sunlight. Unlike most other display technologies, electronic paper has image memory. In other words, once an image is displayed, no power is required to maintain the image content. The image remains after power is removed.

Electronic paper is flexible and can conform to various shapes. Electronic paper is suitable for mounting on curved surfaces due to its thin form factor and inherent flexibility. Unlike other display technologies such as liquid crystal displays (LCD), an image displayed on electronic paper looks the same from all viewing angles and will not distort when touched or flexed, making electronic ink a preferred display medium for flexible displays.

There are many methods of forming electronic paper. The type that will be described in most detail herein is a form of "electrophoretic" display technology, because it is based on the principles of electrophoresis (the movement of an electrically charged substance under the influence of an electric field). Other technologies being applied to electronic paper include electrochromic displays, modified versions of liquid crystal displays and cholesteric displays.

Figure 3:
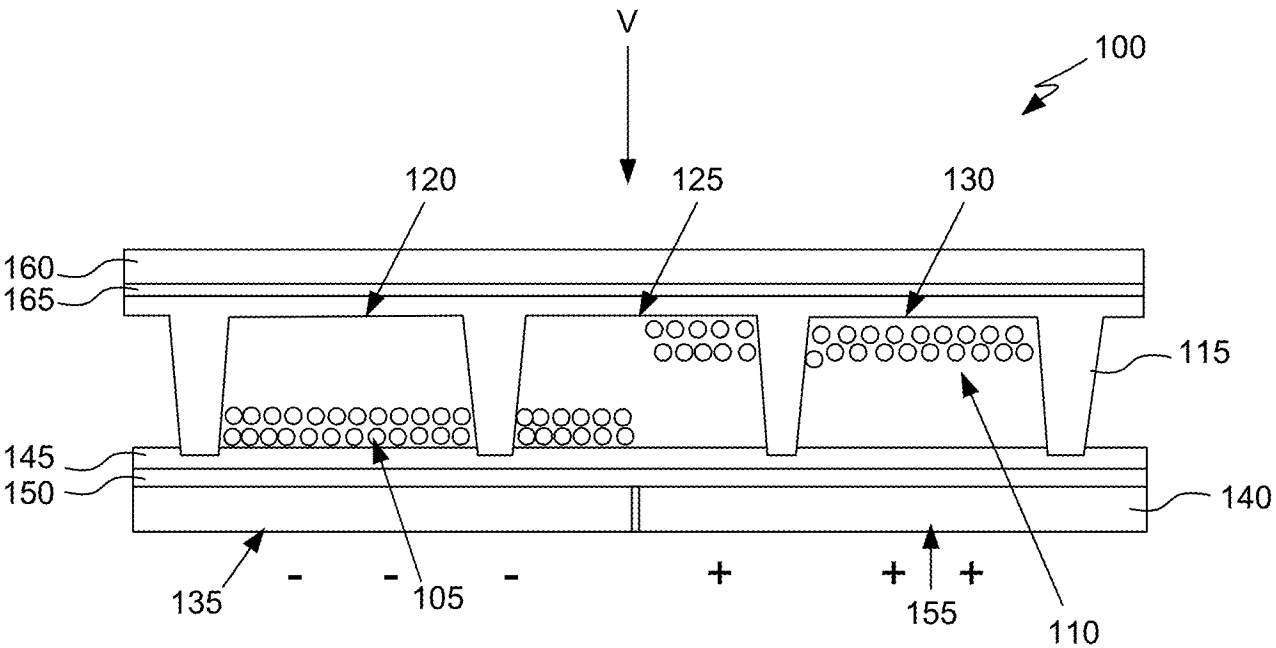
FIG. 3 shows a cross-sectional view of electronic paper.

Turning first to FIG. 3, a cross-sectional view of electronic paper 100 is shown. The description of electronic paper herein provides one example of how electronic paper can be formed, as should be appreciated by those skilled in the art. In FIG. 3, electronic paper 100 is formed of electronic ink, which includes electrically charged particles 105 in a dielectric fluid 110. Cell walls 115 and sealing layer 145 constrain the dielectric fluid within to predetermined microcapsules or cells, including cells 120, 125 and 130. Sealing layer 145 is attached to a conductor 140 by adhesive 150. The cells, sealing layer 145 and transparent surface 160 may be formed of various types of plastic material or other similar material. In this example, transparent surface 160 is formed of PET plastic, but any other suitable material may be used. In some implementations, even conductor 140 is formed of conductive plastic. Dielectric fluid may be any convenient type of colored dielectric, such as non-toxic oil. An additional conductor layer 165 is adjacent to transparent surface 160. Because the display is viewed through conductor layer 165, conductor layer 165 is preferably also transparent, e.g. a transparent conductive plastic. The conductive layers 140 and 165 can be formed of indium tin oxide ("ITO").

In FIG. 3, in one example, particles 105 are white and are positively charged. However, other colors and charges may be used. When a negative charge is formed in area 135 of conductor 140, all of the charged particles 105 in cell 120 and a portion of the charged particles 105 in cell 125 migrate through dielectric fluid 110 towards conductor 140. Similarly, when a positive charge is formed in area 155 of conductor 140, all of the charged particles 105 in cell 130 and a portion of the charged particles 105 in cell 125 migrate through dielectric fluid 110 away from conductor 140 and towards transparent surface 160. When the white particles are adjacent to transparent surface 160, that area of the display (here, the area corresponding with cell 130 and the adjacent portion of cell 125) reflects a white "color" to viewer V. Otherwise, the display will reflect the color of the dielectric fluid, which may be any convenient color. In this example, the area of the display corresponding with cell 120 and the adjacent portion of cell 125 reflects the color of the dielectric fluid.

Multi-color electronic paper is preferably implemented to form a bi-stable display for use with embodiments of the present invention. In one example, multiple layers of electronic paper similar to that shown in FIG. 3 can be used to produce color configurable surfaces. One such type of color electronic paper has been jointly developed by Fujitsu Laboratories Ltd., Fujitsu Frontech Limited, and Fujitsu Limited (collectively, "Fujitsu"), and was exhibited in July of 2005 at the Tokyo International Forum. This electronic paper includes one layer for producing red, one layer for producing blue and one layer for producing green. No color filters or polarizing layers are required, though they could be used with such a product. Another type of color electronic paper that can readily be implemented in the present invention was developed by E Ink Corporation and Toppan Printing Co. Ltd. As announced on Oct. 18, 2005, this alternative type of colored electronic paper uses a color filter having a high-brightness layout (red/green/blue/white) that can present white or black for background, text, etc., as well as a range of colors and tones. Those of skill in the art will appreciate that displays with configurable surfaces constructed according to embodiments of the present invention can incorporate, at least in part, these and other types of color electronic paper now in existence or that will be developed in the future.

Figure 4A:
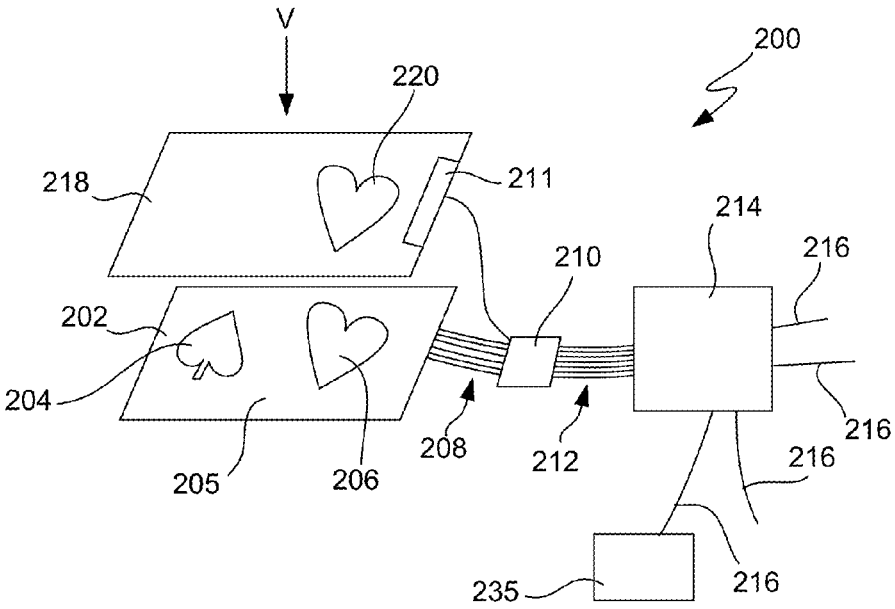
FIG. 4A shows an example of electronic paper and related control systems.
Figure 4B:
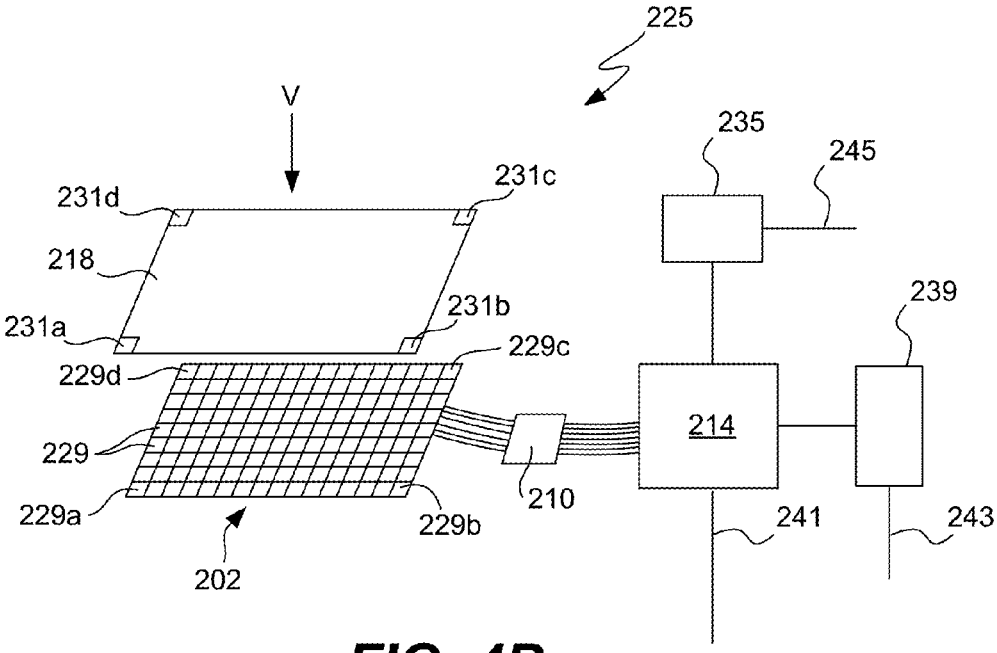
FIG. 4B shows another example of electronic paper and related control systems.

To provide control over the information displayed on the electronic paper 100, the electronic paper is laminated to a layer of circuitry. The circuitry includes patterned conductors forming a pattern of pixels that can be controlled by a suitable controller and/or processor to provide the desired resolution for display of symbols on the electronic paper. FIGS. 4A and 4B show examples of electronic paper control systems with control circuitry and patterned conductors to display information on regions of bi-stable displays constructed according to embodiments of the present invention.

In the example shown in FIG. 4A, electronic paper 200 includes patterned conductor 202 that has been segmented according to shape 204, shape 206 and background portion 205. Electronic paper 200 further includes layer 218 with cells containing dielectric and charged particles, as described above with reference to FIG. 3. Although not illustrated, layer 218 preferably incorporates additional color layers and/or a color filter to provide color electronic paper, as described above. Although layer 218 is shown to be separated from conductor 202 in FIGS. 4A and 4B, this is only for purposes of illustration; in practice, these layers are joined, e.g., by a lamination process.

A controller operatively coupled to control the output of information on the electronic paper 200 includes a driver chip 210 and display processor 214. Those skilled in the art will appreciate that driver chip 210 and display processor 214 represent one possible implementation of the controller. Driver chip 210 is in communication with conductor 202 via connections 208 and in communication with display processor 214 via connections 212. Here, common ground electrode 211 is also connected to driver 210. In alternative implementations, driver 210 may be implemented as software executed by, e.g., display processor 214. Display processor 214 may communicate with other devices, including memory 235, via connections 216.

In this example, within the area of shape 204 or 206, driver 210 will cause a charge to be applied. Accordingly, all of shape 204 or 206 may be directly driven and separately controlled. When driver 210 causes charges to be applied to shape 206, as explained above, predetermined colors, including black and white for purposes of this discussion, are visible to observer V in area 220. In one implementation, observer V would see the color, or colors, of the dielectric in the remainder of layer 218, often a white or cream color.

When layer 218 is implemented to provide multiple colors, various effects may be created, including a segmented display such as that depicted in FIG. 4A. For example, the same display may include an effect similar to that used with mosaics (e.g., the mosaics), a patterned "fill" within a segmented area or any other desired color combination. "Pointillism" effects (wherein the perception of non-primary colors induced by the visual mixing of closely-spaced points of primary colors) may be created by distribution of colored dielectric during fabrication of layer 218 and/or by activating selected colored cells in a matrix. The latter technique may be better implemented with the version of electronic paper described below with reference to FIG. 4B.

Segmented electronic paper such as electronic paper 200 is simple to control. The instruction set for controlling electronic paper 200 can be basic. As such, it requires only a small amount of memory 235 and an inexpensive display processor 214. Segmented electronic paper may advantageously be used for static features such as symbols, logos, dollar signs, other currency signs, dollar amounts, and the like. Although these features are static, segmented electronic paper may be used to provide a range of such static features that may be switched on or off. In some implementations, however, such switching could be used to implement simple types of animated displays.

Moreover, segmented electronic paper may be used in combination with electronic paper having greater display flexibility, such as that provided by a more complex patterning in the conductor. An example of one electronic paper 225 will now be described with reference to FIG. 4B.

Electronic paper 225 is an active matrix type of electronic paper, which is made possible by a finer granularity of the patterning in conductor 202. In this example, conductor 202 has been partitioned into rectangular cells 229, each of which is independently addressable and controllable by processor 214, via driver 210. When driver 210 causes charges to be applied to cells 229*a*, 229*b*, 229*c* and 229*d* of conductor 202, charged particles and/or dielectric in layer 218, depending on the desired implementation, are visible to observer V in the corresponding cells 231*a*, 231*b*, 231*c* and 231*d*. As mentioned before, the charged particles maybe a "color" other than white, may be negatively charged, may be differentially charged on opposing sides, etc.

In FIG. 4B, although this example uses a conductor patterned into rectangular cells, any convenient cell shape may be used. If the cells are sufficiently small, they can be controlled much like pixels of an LCD or similar display device. Both static and dynamic images may be presented. Depending on the size and complexity of the display, there may be more demands on display processor 214 for an active matrix display than for a segmented display. Moreover, additional memory may be required. Therefore, in this example, display processor 214 is configured for communication with memory devices 235 and 239. Each of these devices is configured for communication with other devices, if necessary, via connections 241, 243 and 245. In this example, memory device 235 is a flash memory device and memory device 239 is an SRAM. However, any convenient type of memory device may be used.

In FIG. 4B, if layer 218 includes cells having different colors of dielectric material, cells 229 may be controlled to produce pointillism effects or similar effects. Only the three primary colors are needed to produce a wide range of perceived colors. For large configurable surfaces and/or configurable surfaces that are at a medium distance from the viewer (e.g., a wall or ceiling surface), such effects may be particularly interesting and entertaining.

Figure 5A:
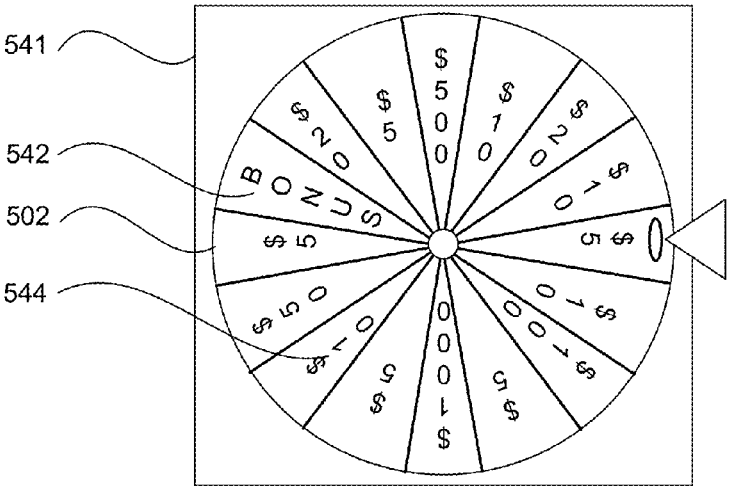
FIG. 5A shows a front-view of a rotating active electronic display system.
Figure 5B:
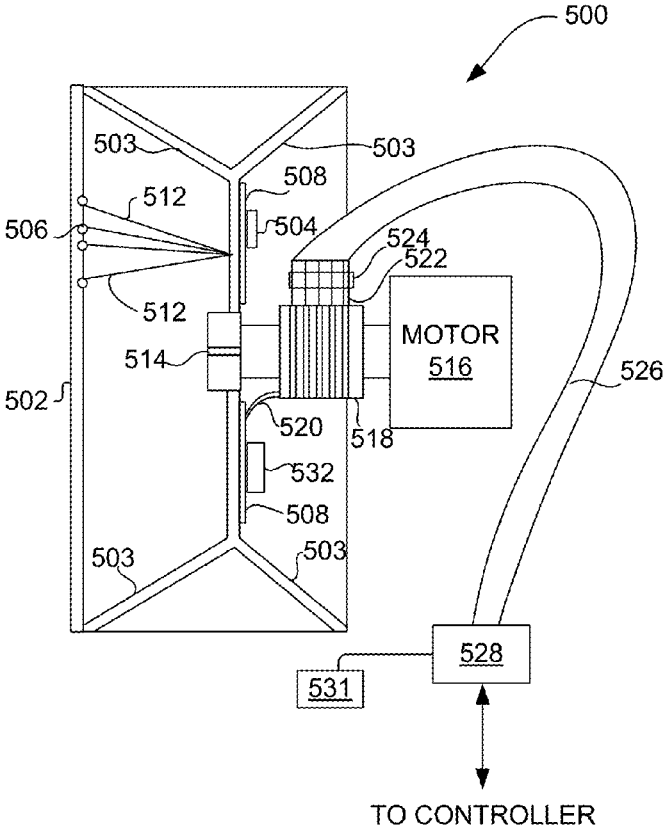
FIG. 5B shows a cross-sectional view of the rotating active electronic display system of FIG. 5A.

FIGS. 5A and 5B show cross-sectional views of a rotating active electronic display system 500, constructed in accordance with one embodiment of the present invention. Specifically, display system 500 includes an active electronic display 502 on the front surface of an internal or supporting member 503. Active electronic display 502 is constructed of a configurable surface having various configurable regions of bistable material displaying dollar signs, bonus amounts, etc, as discussed above. In other examples described below, an active electronic display is constructed of different active elements.

In FIGS. 5A and 5B, active display 502 optionally includes one or more integrated circuits 504 implementing controllers which process data to control output of selected symbols on the bi-stable material of the various configurable regions. As mentioned above, in one implementation, each controller in integrated circuits 504 can incorporate a driver chip and a display processor. In one implementation, one or more of the integrated circuits 504 can implement a movable display controller. In addition, in one embodiment, the integrated circuits 504 include one or more circuit elements controlling the supply of power to at least portions of the active electronic display 502. In one implementation, a separate power connection to each configurable region is provided, so that each configurable region can be separately powered on when an update is desired. In another implementation, all of the configurable regions are connected to the same power connection, so all of the configurable regions are powered on or off together. Data provided by an internally or externally situated movable display controller or other control device such as a server can be delivered to active electronic display 502 via a display connection 506. Electrical power can also be supplied via a power line on display connection 506.

In one embodiment, the movable display controller, and/or one or more individual controllers of the separate configurable regions, can be implemented in circuitry provided as integrated circuit 504. Integrated circuit 504 is provided on a printed circuit board 508 mounted on the interior of supporting member 503, as shown in FIG. 5B. Printed circuit board 508 may include one or more integrated circuits 504 as shown. Control signals output from the circuitry on printed circuit board 508 are provided to display connection 506 via a plurality of lines 512. Alternatively, printed circuit board 508 may be mounted elsewhere, for example directly mounted to active electronic display 502.

In FIG. 5B, supporting member 503 rotates about an axis of rotation 514 and is driven by a drive motor 516. Motor 516 also drives a slip ring drum 518 attached to axis of rotation 514. Slip ring drum 518 includes multiple contacts connected to circuitry on printed circuit board 508 by a cable 520. Thus, slip ring drum 518, cable 520 and printed circuit board 508 all rotate together about the axis of rotation during rotation of active electronic display 502 by drive motor 516. Control signals and a power connection from outside display 502 can be provided to display 502 by brushes 522 mounted to a brush block 524. Signals to the brush block 524 are provided by a cable 526 which is mounted to a connector 528. In one embodiment, lines from connector 528 are provided to an externally situated movable display controller. In another embodiment, the lines from connector 528 are provided to a master gaming controller, or other processing device, which controls the symbols and/or outcomes of the game of chance. The display 502 and other similarly constructed displays may be mounted on a stand within housing 541. In one implementation, the cable 526 and connector 528 have one or more data lines providing paths for the transmission of symbol information to be displayed on designated regions of display 502. A power line can be provided in cable 526 and connector 528 to power the circuitry controlling the updating and display of symbol information on the bi-stable material of display 502. Alternatively, the power line can be provided in a separate cable and/or connector, depending on the desired implementation. The power supply can be a conventional supply, including inductive power coupling techniques. Rotating elements including support member 503, active electronic display 502, printed circuit board 508, etc together form a rotating display assembly or wheel, which rotates about axis 514.

One benefit of using bi-stable configurable material to form display 502 is that the control and power signals provided to the brush block 524 can be intermittent. That is, power and data signals only need to be provided when one or more configurable regions on the display are updated. When the symbols are displayed, for instance, when a wheel is spinning during game play, there is no need to continue powering the individual configurable regions, nor is there a need to continue providing data to these regions. The displayed information on the region remains, regardless of whether power or data signals are provided. Thus, a switching mechanism can be operatively coupled at a desired location along the signal and power path to switch off the data signal and power between updates. In one embodiment, the switching mechanism is implemented to time the switching on of power with the sending of data in the data signal and outputting of the information for display on the configurable regions of the display. Thus, in the embodiment described above, when the wheel not rotating, the slip ring drum 518 and printed circuit board 508 can be powered on for a length of time necessary to update the configurable regions, and then powered off when the update is complete.

In another alternative, power and communication may only be possible when the wheel is not rotating. The wheel may have contact pads at one location, with corresponding contact probes mounted at an opposing location. The probes may be brought into contact with the pads when the wheel is rotated to the appropriate location. When the probes are in contact with the pads, electrical connections are formed that allow transfer of electrical power and data.

Figure 5C:
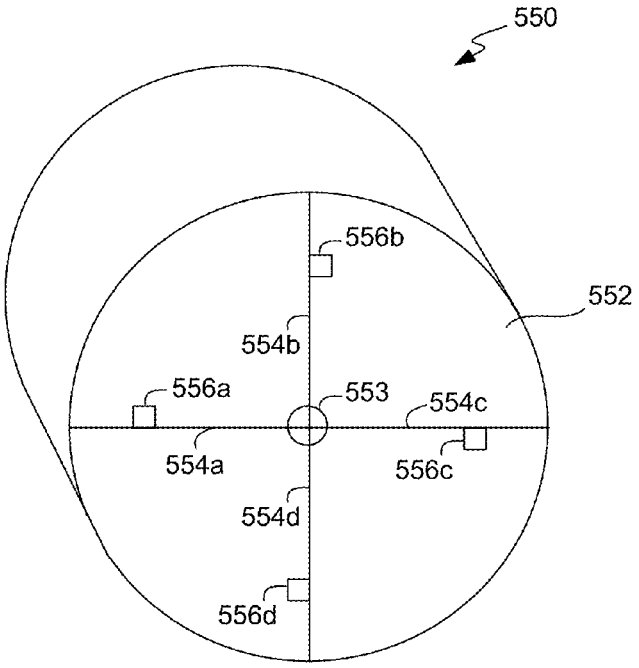
FIG. 5C shows a cross-sectional view of an alternative rotating active electronic display system.

FIG. 5C shows a cross-sectional view of a wheel 550 constructed according to another embodiment of the present invention. In this embodiment, the wheel 550 is constructed to provide generation of electrical power by harnessing the rotational energy of wheel 550. The wheel 550 includes a display disposed on the front surface of an internal supporting member 552. Rather than incorporating slip rings like the embodiment of FIG. 5B, magnetic pickup coils are placed about axes of the axle 553 of wheel 550. In one implementation, supporting member 552 has spokes 554*a*, 554*b*, 554*c*, and 554*d* arranged along its axes as shown in FIG. 5C. Magnetic pickup coils 556*a*, 556*b*, 556*c*, and 556*d* are mounted on or proximate to the respective spokes 554*a-d*. Electromagnets are mounted and positioned on the motor 516 of FIG. 5B or other suitable location proximate the pickup coils 556*a-d*. Thus, when the electromagnets are energized, electrical energy can be generated at the magnetic pickup coils 556*a-d* when the coils move past the magnets as wheel 550 is rotated. The wheel 550 may be combined with any suitable display and provides a source of power for the display as long as the display is rotating.

Figure 5D:
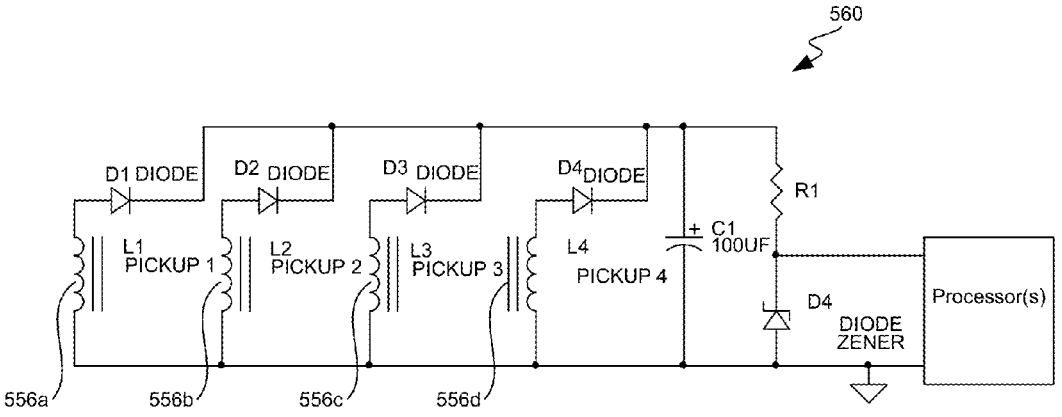
FIG. 5D shows control circuitry for the rotating active electronic display system of FIG. 5C.

FIG. 5D shows control circuitry 560, which is coupled to rectify, store, and regulate electrical energy made available at pickup coils 556*a-d* of FIG. 5C. In FIG. 5D, control circuitry 560 includes circuit elements coupled between pickup coils 556*a-d*, and the processor(s), communications apparatus, and bi-stable material of display 502. The various circuit elements are coupled as shown in FIG. 5D to regulate voltage supplied to the processors and other various apparatus on the wheel. The control circuitry 560 can be mounted on the wheel 550, on the stand 530, or other suitable location as desired, depending on the particular implementation.

In yet another alternative embodiment, power is generated using a photovoltaic cell located on a wheel. A light source is located on the motor 516 or other suitable location on the stationary portion of the system, and positioned to energize the photovoltaic cell. As with the embodiment of FIG. 5C described above, the photovoltaic cell and light source are situated to provide electrical power during rotation of the wheel.

In another example, power is supplied by a battery in the wheel, which rotates with the wheel. Such a battery may be replaced periodically, or may be recharged, either when the wheel is stationary, when it is rotating, or both. Such a battery may be recharged using any of the energy transfer systems described above. In one example, such a battery is recharged when the wheel is stationary using probes that connect to contacts as described earlier.

Other alternatives include thermal transfer of energy, using for example thermoelectric components on a wheel to obtain power from a heating element that is stationary. Inductive coupling via radiofrequency (RF) induction may be used also.

Returning to FIG. 5B, in one alternative embodiment, rather than communicating display information through the slip ring drum 518, cable 520, brushes 522, brush block 524, and cable 526, an optical, RF or other suitable wireless transmitter and receiver are coupled to pass the information. Thus, in this embodiment, slip ring drum 518, cable 520, brushes 522, brush block 524, and cable 526 can be omitted from the mechanism and replaced with wireless communications apparatus. As shown in FIGS. 5A and 5B, in one embodiment, a wireless receiver 532 is coupled to printed circuit board 508 to receive symbol display information from a wireless transmitter 531 coupled at a desirable location proximate the wireless receiver 532. Depending on the desired implementation, the wireless transmitter 531 can be coupled to the connector 528, as shown in FIG. 5B, or can be mounted and coupled to other apparatus of the gaming machine.

In one implementation, wireless transmitters such as wireless transmitter 531 can be portable and coupled to portable handheld devices such as PDAs, cell phones, laptop computers, and other data processing apparatus and devices. In this way, the wireless transmitters can be carried about the gaming environment by IGT technicians or other authorized individuals. Preferably, a suitable authentication process is performed before enabling communications between the transmitter and receiver. Secure communications protocols, for instance, using conventional encryption techniques, are preferably applied to pass the information. In one embodiment, transceiver apparatus including the transmitter and receiver described above are disabled during game play to prevent tampering and cheating.

In one implementation, a bank of slot machines is desirably updated to have the same or similar symbol information displayed on the wheels of all the machines in the group. For instance, a plurality of machines may be located in a particular area of a gaming environment, in which the environment can be changed to reflect certain themes. When the theme changes, it can be desirable to update the graphics and information displayed on the various gaming machines in the bank. In one embodiment, the same symbol information is passed to part or all of the machines for updating the wheels on the machines to show the same information. In another embodiment, a further communications line identifies particular machines to be updated. Symbol update information is routed to the appropriate machines, for instance, all or part of the machines in a bank. Wired or wireless communications techniques including those described herein can provide the transmission of data to a wheel.

In an embodiment employing wireless data communications, the wireless transmitter and receiver are desirably powered on for a period of time to transmit and receive the symbol display information, and then powered off. Preferably, symbol update information is passed when the wheel is stopped to avoid data corruption from noise generated by friction of mechanical parts during rotation of the wheel.

Electroluminescent Displays

Figure 6A:
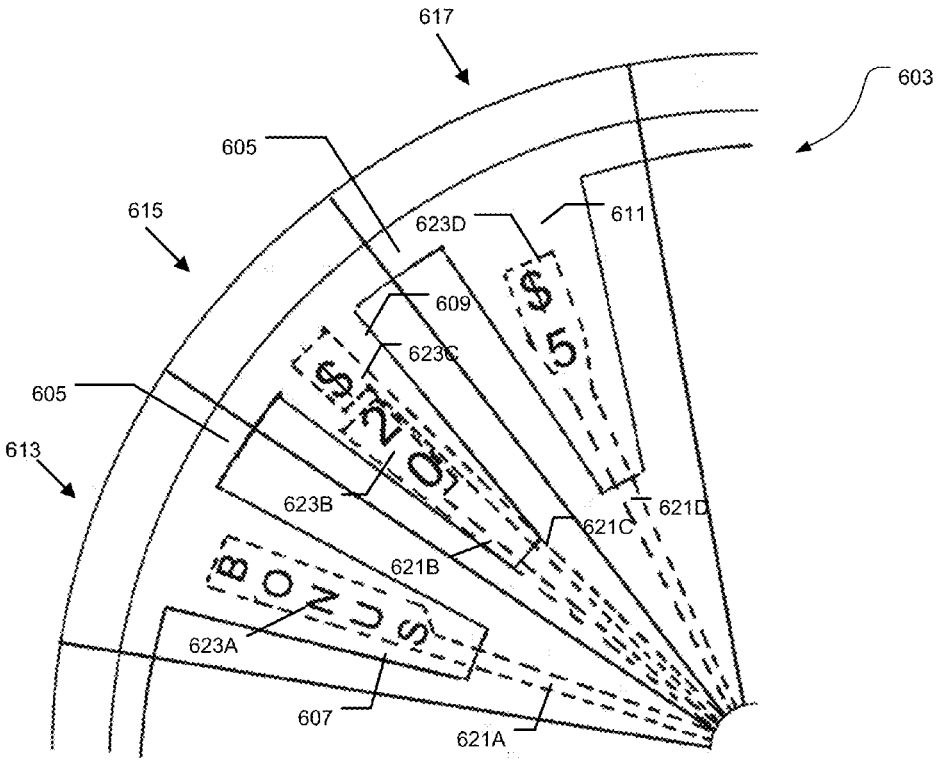
FIG. 6A shows a portion of an electroluminescent display.
Figure 6B:
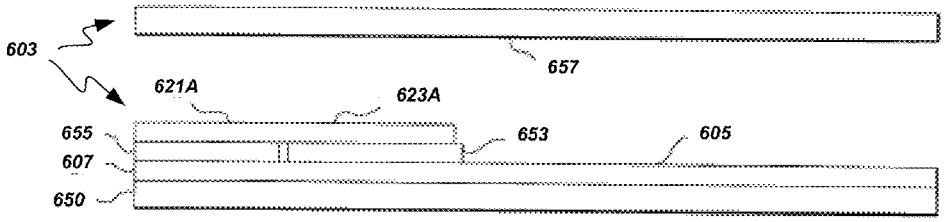
FIG. 6B shows a cross-sectional view of a portion of the electroluminescent display of FIG. 6A.

Various active electronic displays may be used in a similar manner to the bi-stable display described above to achieve an electronically configurable rotating display, which can simulate a rotating wheel or other objects. One such alternative active electronic display is an electroluminescent display. Examples of electroluminescent displays and methods of using such displays are described in U.S. Pat. No. 6,027,115, which is hereby incorporated by reference in its entirety. FIGS. 6A and 6B show a portion of an electroluminescent display 603 used in a similar arrangement to the bi-stable display discussed above. FIG. 6A presents a view of display 603 and showing three sectors 613, 615 and 617. In this embodiment, the individual light elements on the sectors of display 603 are electroluminescent elements. Each electroluminescent element is defined by a capacitor having two "conductive" plates and an electroluminescent dielectric sandwiched therebetween. Each electroluminescent element in display 603 must be independently controllable. Thus, separate lines are provided to at least one of the conductive plates of each such element.

In the embodiment depicted, one plate is provided by a continuous portion of conductive material. This portion includes trace segments 605 connecting individual conductive plates 607, 609 and 611 in adjacent sectors 613, 615, and 617. While not depicted in FIG. 6A, traces 605 would connect additional conductive plates distributed about all sectors of display 603. Traces 605 may be connected to a single connection at the center of display 603, or may have separate connections to one or more controllers.

To simplify the illustration, electroluminescent elements are not explicitly depicted in FIG. 6A. The electroluminescent material associated with the symbols in sectors 613, 615, and 617 defines the shape of the symbol items themselves. Thus for example in sector 613, the electroluminescent dielectric element defines the BONUS symbol shown. Similarly, in sector 615, the electroluminescent dielectric defines a $20 symbol and in region 617, the electroluminescent dielectric defines a $5 symbol.

The individual electroluminescent elements in the various symbol regions are independently controlled by separate traces 621A-D. Each of these traces terminates in a conductive plate associated with the electroluminescent element it controls. For example, trace 621A terminates in a conductive plate 623A which controls illumination of the BONUS symbol in sector 613.

In sector 615, two separate traces, 621B and 621C control illumination of two separate electroluminescent elements comprising the $20 symbol. As shown, trace 621B terminates in a conductive plate 623B which illuminates the 20 portion. Conductive trace 621C terminates in a conductive plate 623C which controls illumination of an electroluminescent element controlling the $ portion.

Conductive trace 621D terminates in a capacitor plate 623D which controls illumination of the "$5" of sector 617. Preferably, the conductive traces 621A-D and the capacitor plates 623A-D that they terminate in are made from a conductive yet transparent material. One such material is indium tin oxide.

FIG. 6B presents a cross-sectional view of a portion of electroluminescent display 603. As shown, display 603 includes a polymeric substrate 650 made from a flexible material such as polyester. A conductive layer such as aluminum is formed on substrate 650. This layer is patterned to comprise traces 605 and lower capacitor plates such as plate 607. Next, an isolation layer 655 is formed over substrate 650 including traces 605 and capacitor plate 607. Isolation layer 655 is then patterned to define electroluminescent regions. Within these regions, electroluminescent dielectric elements such as element 653 are formed. On top of this structure, traces such as trace 621A and capacitor plates such as plate 623A are formed. Again, this material is preferably a transparent conductor such as indium tin oxide. This layer should be transparent so that light generated from electroluminescent elements such as element 653 will be visible to the slot machine player.

The entire electroluminescent capacitor structure described until now is covered with a printed cover layer 657. This cover layer should be transparent except where inked symbol images have been printed. Preferably, such images are silk screened onto cover layer 657. In one example, cover layer 657 is made from a flexible material such as Mylar.

An electroluminescent display may be provided with a suitable supply of electrical power, generally a high-frequency AC voltage. Frequencies between about 30 Hz and 2500 HZ may be used, and frequencies between 600 and 900 Hz may be used to provide good life span and brightness. A power supply to provide such high-frequency AC power may be incorporated as part of an active electronic display system, either as a rotating component (i.e. as part of the wheel) or as a non-rotating component. Power may be provided to such a power supply in any suitable manner, including the different methods described above.

It will be understood by those skilled in the art that the bi-stable and electroluminescent displays described above are just two examples of active electronic displays that may be used according to embodiments of the present invention. Other examples include LCD displays, LED displays, OLED displays, plasma screen displays, other flat panel displays, and CRT displays. Also, such active displays may be used in combination with each other, and may be used in combination with projection-based displays.

Light Valve

Figure 7:
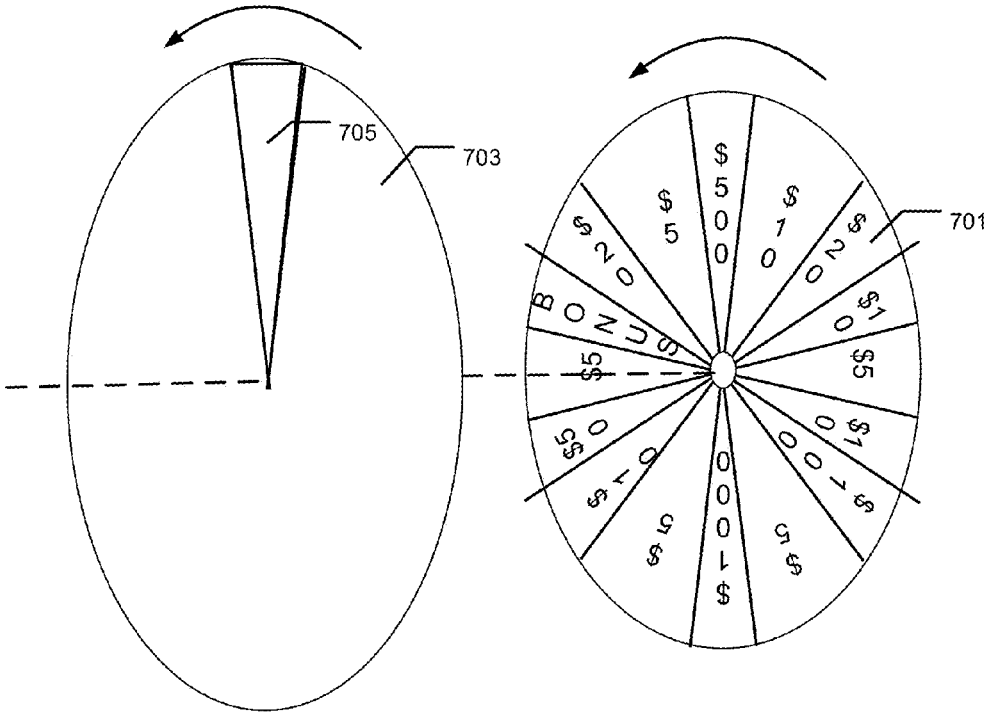
FIG. 7 shows a rotating light valve that obscures a portion of a display.

According to embodiments of the present invention, a display system may include a light valve that is used to obscure at least part of a display. Examples of light valves and methods for using them are provided in U.S. Pat. No. 7,309,284, which is hereby incorporated by reference in its entirety. FIG. 7 shows an example of a light valve that is used to obscure a portion of a display. In particular, FIG. 7 shows a display 701 that presents an image of a wheel. The display is configured so that the image rotates and appears to a player to be a rotating wheel. In this example, the physical display remains stationary while the image that it presents rotates. As shown in FIG. 7 a rotating object 703 is located in front of the display 701 (between the display and a player). The object in this example is disk shaped, though other shapes may be used. The object is made to rotate at the same speed that the image on the display rotates. A sector 705 of the object (a pie slice) is configured to be opaque, with the rest of the object 703 being transparent. The sector 705 is made of a material that can be electrically configured to be either transparent or opaque. The object 703 may be divided into sectors corresponding to the sectors of the display image, so that any combination of sectors may be made opaque, or only a single sector may be configurable in this way. The sector may be configurable in real-time as the object is rotating, or may be configurable only when it is stationary, in which case it retains the last configuration provided until the next time it is stopped and reconfigured. According to an example, sectors of the display are revealed to a player as the player advances in a bonus round of a game. Thus, until a player is eligible to win a particular prize, the symbol relating to that prize is obscured. Once the player is eligible to win the prize, the symbol is revealed to the player. The opaque sector of FIG. 7 is a light valve that acts as a configurable shutter to obscure a selected one of the sectors of the display. The object is synchronized with the rotating image so that the light valve remains in front of a single sector of the image. In the example shown, the sector with the symbol: $500 is obscured. In other examples, light valves may be configured in other shapes to obscure different portions of displays.

While a single display is shown here, more than one display units may also be used behind such an object. The one or more electronic display units may be, for example, a cathode ray tube (CRT) display, a flat panel display (FPD), a front projection display, or a rear projection display. Moreover, additional mechanically moveable members may also be disposed behind the light valve.

Various devices may be utilized for the light valve, including, but not limited to, suspended particle devices (SPD), electrochromic devices, polymer dispersed liquid crystal (PDLC) devices, etc. Generally, the light valve may switch between being transparent, and being opaque (or translucent), depending on whether a current is applied or not. For example, SPDs and PDLC devices become transparent when applied with a first voltage and become opaque or translucent when a second voltage is applied, with the second voltage being very low or approximately zero. On the other hand, electrochromic devices become opaque when applied with a voltage, and transparent when little or no voltage is applied. Additionally, the light valve may attain varying levels of translucency and opaqueness. For example, while a PDLC device is generally either transparent or opaque, suspended particle devices and electrochromic devices allow for varying degrees of transparency, opaqueness or translucency, depending on the applied voltage level.

In another example, the entire object may be configured to be opaque so that a player's view of the entire display may be obscured (or blocked). The light valve may also be translucent and provide varying degrees of visibility of the display, thereby varying the visibility of the display (e.g., gradually "dimming" or "brightening" the visibility of the display). Varying the translucency of the light valve may cause the visibility of the display to range from allowing the player to view and recognize the images on the display to merely allowing light and color through without being able to distinguish the images.

Figure 8:
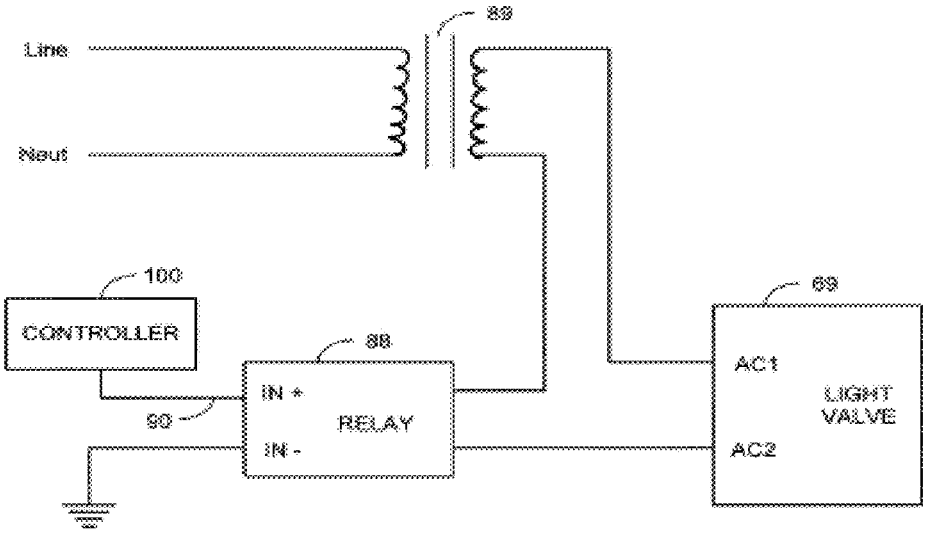
FIG. 8 shows a schematic diagram of a light valve according to an example.

FIG. 8 is an exemplary schematic diagram of a light valve 69. The light valve 69 is controlled with the use of a controller 100 that is coupled to a solid state relay device 88. The controller 100 causes the relay device 88 to turn on and off as needed by the gaming apparatus 20. In doing so, the AC voltage is turned on and off the light valve 69. A transformer 89 is used to isolate a 120 VAC input voltage from the light valve 69 and to change the potential from 120 VAC to about 50 VAC. The controller 100 causes the relay device 88 to turn on and off. A high level sent from the controller 100 on line 90 turns on the relay device 88, causing the light valve 69 to become substantially transparent. A low level sent from the controller 100 on line 90 turns off the relay device 88, causing the light valve 69 to become opaque. The relay device 88 may be solid state optronic SP646 and the light valve 69 may be a SPD, model APD-Gray that is manufactured by InspecTech Aeroservice, Inc. from Ft. Lauderdale, Fla.

It should be noted that while the light valve 69 shown in FIG. 8 is operatively coupled to the controller 100, the light valve 69 may be coupled directly to a power source so that the function of the light valve 69 is based solely on the presence of power applied to the light valve 69. In other words, whenever the gaming unit has power, the light valve 69 could be made transparent. But when power to the light valve 69 is interrupted, the light valve 69 would become opaque and block the view of any components disposed within the housing 50 that are behind the light valve 69.

In an alternative arrangement, electroluminescent bars may be provided on a rotating object in front of a display to configurably obscure at least a portion of the display. Such bars may obscure a sector of a wheel image on such a display or may enhance the image shown on the display by providing a more striking image.

Synchronization

Where an object is rotated in front of a display (e.g. the object with light valve of the above example) it may be desirable to coordinate the rotation of the object with an image presented by the display. For example, where the display shows a rotating wheel, it may be desirable to have the rotating object rotate at the same speed as the image to give the impression of a single physical object that is rotating. In order to provide a convincing impression of a single physical object rotation speeds should be matched closely. This can be done in different ways including ensuring that the speed of the rotating object and the speed of the image are controlled together, or matching one rotation speed to the other rotation speed using some feedback regarding rotation speed (generally, this means matching the rotation speed of the rotating object to that of the display image though the reverse may also be performed)

Figure 9:
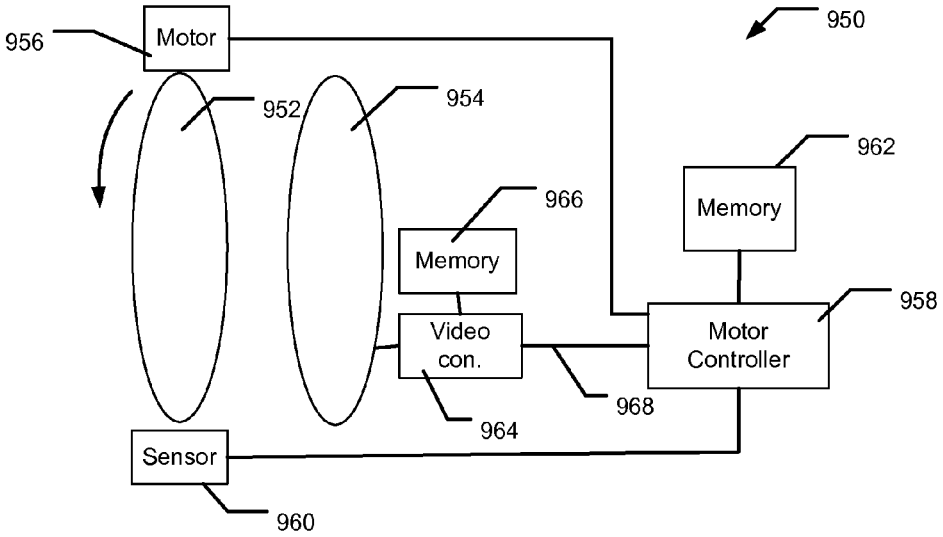
FIG. 9 shows a rotating object in front of a stationary video display.

FIG. 9 shows an apparatus 950 that includes a rotating object 952 in front of a stationary video display 954. The rotating object is rotated by means of a motor 956 that is coupled to the rotating object 952 by friction. The motor is controlled by a motor controller 958. For example, the motor may be a stepper motor and the controller may control how many steps the motor goes through in a given period. The motor controller 958 also receives input from a sensor 960. The sensor provides feedback to the motor controller regarding the position of the rotating object. In this way the motor controller can monitor the actual position of the rotating object so that if there is any slippage in the motor-to-object coupling (or elsewhere) then the controller can compensate and maintain the rotational speed of the rotating object. The motor controller 958 is in communication with a memory 962 which contains one or more profiles for movement of the rotating object 952. Such a profile may include an acceleration phase up to a cruise speed, a period at cruise speed, and a deceleration (negative acceleration) phase. The video display 954 is connected to a video controller 964 which controls the image presented by the video display. The video controller 964 is connected to a memory 966 which contains data for producing a predetermined video representation on the video display. Such data may be recorded video data, or data from which an image is generated through some calculation by the video controller.

As shown here, the video display and the rotating object each have their own controllers that allow each of these components to operate separately. However, in some cases it is desirable to have the video display and rotating object act together, for example by appearing to rotate as a single object. A connection 968 is provided between the video controller and the motor controller for this purpose. Either controller can provide information to the other controller to allow the other controller to match its speed. For example, the motor controller could provide information regarding the rotational position and rotational speed of the rotating object to the video controller to allow the video controller to match the rotational speed of a rotating image to that of the rotating object. In another example, the video controller keeps a video image rotating at a predetermined speed and provides information to the motor controller regarding the rotational position and rotational speed of the image so that the motor controller can match the location and speed of the rotating object to that of the video image.

One simple way to keep the video image and the rotating object synchronized is to ensure that they are both following the same speed profile (i.e. both accelerate at the same rate to the same cruise speed, and then both decelerate together at the same rate). This may be achieved by providing the same profile to both the video controller and the motor controller. In one example, a single profile (e.g. a lookup table) may be shared by both the video controller and the motor controller. One copy of the profile may be stored in the video controller's memory, with another copy stored in the motor controller's memory. Alternatively, the video controller and memory controller may share a memory. In this way, no communication is required between the video controller and the motor controller.

In general, the rotation of the rotating object is monitored by the sensor 960 to ensure that the rotating object is rotating according to the desired profile. The sensor may be an optical sensor (or set of sensors) that monitors a portion of the edge of the rotating object which has an appropriate pattern. This can be as simple as a single flag, or may be a more complex pattern that allows the rotational position and rotational speed of the object to be determined with a high degree of accuracy. The sensor looking at the pattern on the object acts as an encoder to provide a signal to the motor controller that indicates rotational position and speed.

Figure 10:
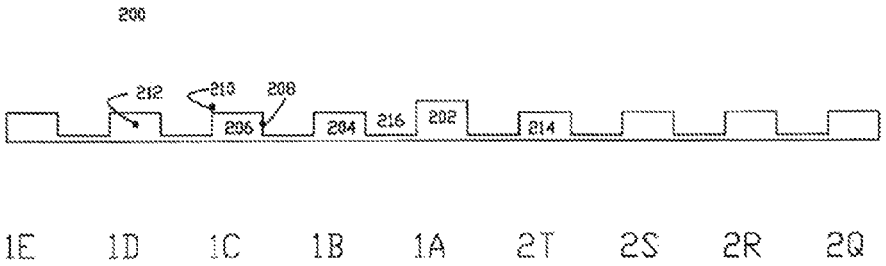
FIG. 10 shows a pattern of flags used for determining rotational position of a rotating object.

FIG. 10 shows an example of a pattern of flags that are placed around the perimeter of a rotating object (e.g. a spinning disc). FIG. 10 also shows locations of three sensors (individual sensor elements within sensor of FIG. 9). These sensors include absolute encoder sensor 210 and quadrature encoders 212, and 208. The perimeter of the object is divided into 45 individual flags in this example, though other numbers of flags may also be used. A key flag 202 is located at position 1A. Key flag 202 is taller than any of the other flags and will interrupt the absolute encoder sensor 210. Key flag 202 is the once per turn flag and when it passes under the absolute encoder 210 it provides the once per turn signal indicating that the disc is in, or is passing through, the home position. Key flag 202 is followed by a lower section 216. This section does not interrupt the absolute encoder sensor 210 or the quadrature encoder sensors 208, 212. The combination of flag 202 and section 216 make up a total of 8 degrees on the circumference of the disc. Flag 202 is also used by the quadrature encoder sensors 208, 212. Quadrature encoder sensor 210 is the sine encoder sensor and quadrature encoder sensor 208 is the cosine encoder sensor. As the rotating disc is rotated the flags pass the three encoder sensors 208, 210, 212, digital pulses are transmitted from the sensors to decoding circuitry which may be part of the sensor, part of the motor controller, or may be separate from both the sensor and the motor controller. One example of such decoding circuitry is an LS7184 integrated circuit from LSI Computer Systems, Inc. The absolute encoder sensor 210 may be used to reset the decoding circuitry. Key flag 202 and lower section 216 occupy 8 degrees of the circumference of the rotating object, and the pattern of flags and lower sections is repeated over 45 sections (though with lower flags than key flag 202). Locations corresponding to these 45 flags are marked as 1A-1Z and 2A-2T. As the flags pass by the sine and cosine encoder sensors 208, 212, pulses from sensors 208, 212 are sent to the decoding circuitry. A total of 180 pulses are sent from each sensor 208, 212 and the decoding circuitry may provide a pulse every 2 degrees of rotation. By using this information, the position of the rotating object may be established within a 2 degree window, and the rotating object may be stopped within such a window. Thus, the rotating object may be stopped at one of 180 rotational positions. These 180 positions may be related to sectors of a spinning wheel.

Figure 11:
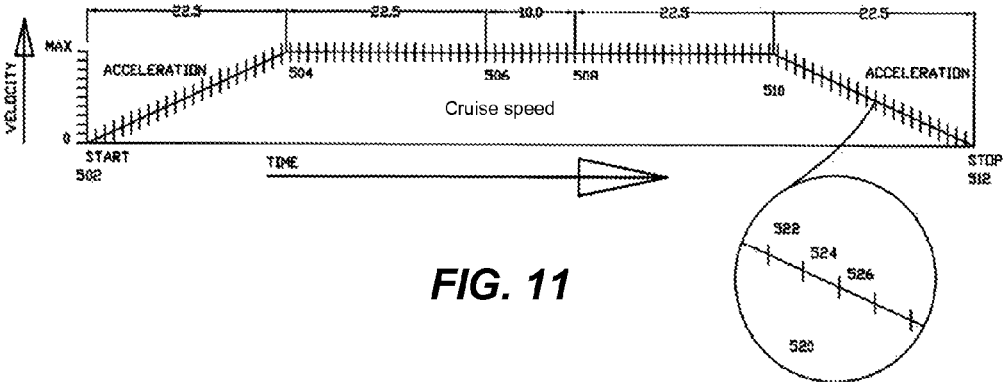
FIG. 11 shows a plot of velocity versus time for a rotating object.

FIG. 11 shows a velocity versus time graph, with velocity on the Y-axis and time on the X-axis. If a command is sent to the motor controller to advance the rotating object to a new location, the following occurs. First, from the starting point 502, the rotating object accelerates for half a revolution until cruise speed is achieved 504. FIG. 11 shows linear acceleration, but any suitable acceleration profile may be used. It may have some negative acceleration at the beginning as the rotating object is rotated backwards for a short period. After acceleration, the object reaches cruise speed 504. Cruise speed may be the maximum speed of the object, or may be some speed that is chosen to appeal to players and to simulate a spinning wheel of a game show. In one example, cruise speed is about 50 to 60 revolutions per minute (rpm). The object is rotated for at least one revolution at cruise speed. In the example shown, additional fill steps are added in the middle of the cruise portion (between 506 and 508) to bring the object to its stop position. Thus, one half revolution occurs from 504 to 506, and another half revolution occurs between 508 and 510, with an additional fraction of a rotation between 506 and 508 to bring the object to the correct rotational position so that it stops at a selected position. Typically, the stop position is determined by a game controller so that it indicates a particular game outcome (e.g. bonus amount). Thus, the number of fill steps between 506 and 508 depends on the starting position and the desired end position. After the fill steps 508, the object continues to rotate for half a rotation and then starts to decelerate (510 to 512). The example shown uses a stepper motor with individual steps shown in detail by view 520.

The profile shown in FIG. 11 may be achieved by providing a corresponding lookup table to the motor controller. According to an embodiment of the present invention, an image on a video display behind the rotating object is rotated according to the same profile. This may be achieved by providing a similar lookup table (or a copy of the same lookup table) to the video controller and the motor controller. An example of such a table may include two columns, one with a reference time and the other with a step number. This type of table may be used to accelerate a stepper motor by defining when power is delivered to a winding of the motor and for what amount of time the power is delivered. The next step in the table may deliver power to a different winding for a different amount of time. As power is delivered to subsequent windings, the motor accelerates according to the table.

In another example, a table may have a single column. The column may include entries that indicate a percentage duty cycle for a DC motor. In this example, the profile is determined by the power delivered to the DC motor according to the table. Other motors may also be used and the present invention is not limited to any particular types of motor.

It should also be appreciated that gearing rations between the motor and the rotating object may require different tables. These differences may be overcome by executing through the same table a different rate or by multiplying values within the table by the gearing ratio.

A method of generating values for the table controlling the motor may use an equation such as the following:

$$RPM = \frac{K1}{S^{K2}} - K3$$

where RPM is the revolutions per minute of the motor, S is the time in seconds and K1, K2, and K3 are constants. In the present example, K1=7.3, K2=0.4, and K3=−5. Another example of a formula used to obtain values is:

$$\mathrm{RPM}=V0(1-e^{-kt})$$

where RMP is revolutions per minute of the motor, V0 is the ending velocity of the motor, e is the natural log, t is the step number, and −k is a constant.

Various methods may be used to translate a table for the motor controller to a table for the video controller (or vice versa). For example, if the values in a column of a table for the motor controller are provided in steps, this may be translated into radians to generate a table that can be used by the firmware of the video controller to rotate the video image at a particular rotational speed.

Figure 12:
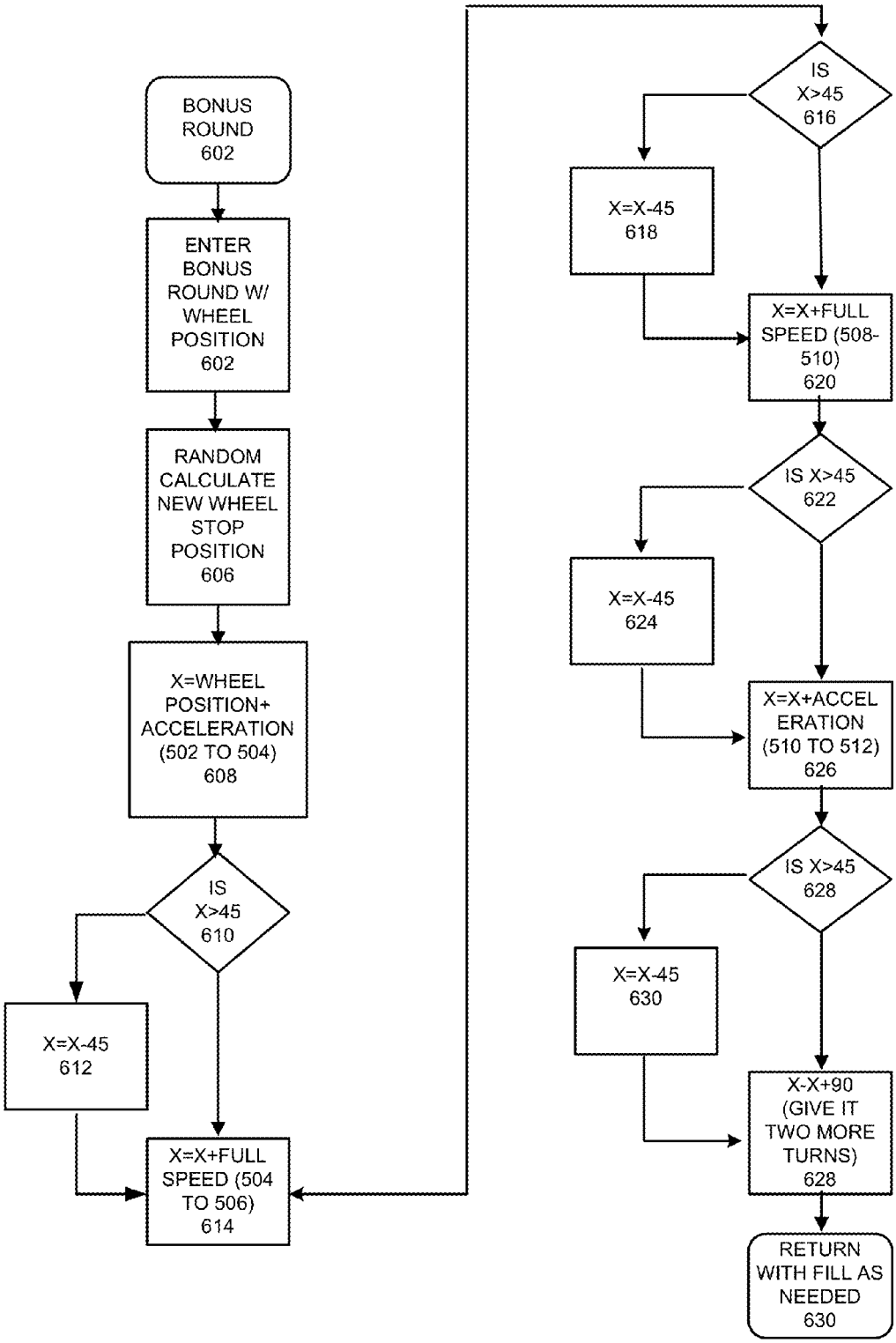
FIG. 12 is a flowchart of a process to calculate the location at which a rotating object is to stop according to an example.

FIG. 12 shows a flow diagram that may be used to calculate the new location of the stopped object. The process starts in block 602 when the game progresses to the bonus round. The new rotating object position is calculated from a random calculation in 606. This new spinning disc position is added to the acceleration steps 608. It is determined if the number of steps for acceleration and getting to the stop position (X) is greater than 45 (610), where 45 is the number of steps for one revolution. If the answer is yes, then 45 is subtracted from X (612) and otherwise X is unchanged. The number of steps at cruise speed is added to X (614) and again it is determined if X is greater than 45 (616). If so, 45 is subtracted from X (618) and if not, X is unchanged. The number of steps for deceleration is then added (620) and again X is checked (622) and reduced by 45 (624) if appropriate. In block 628, additional steps are added so the object will turn through two additional turns. After these calculations, the object will follow the graph of FIG. 11 with fill steps (630).

Figure 13:
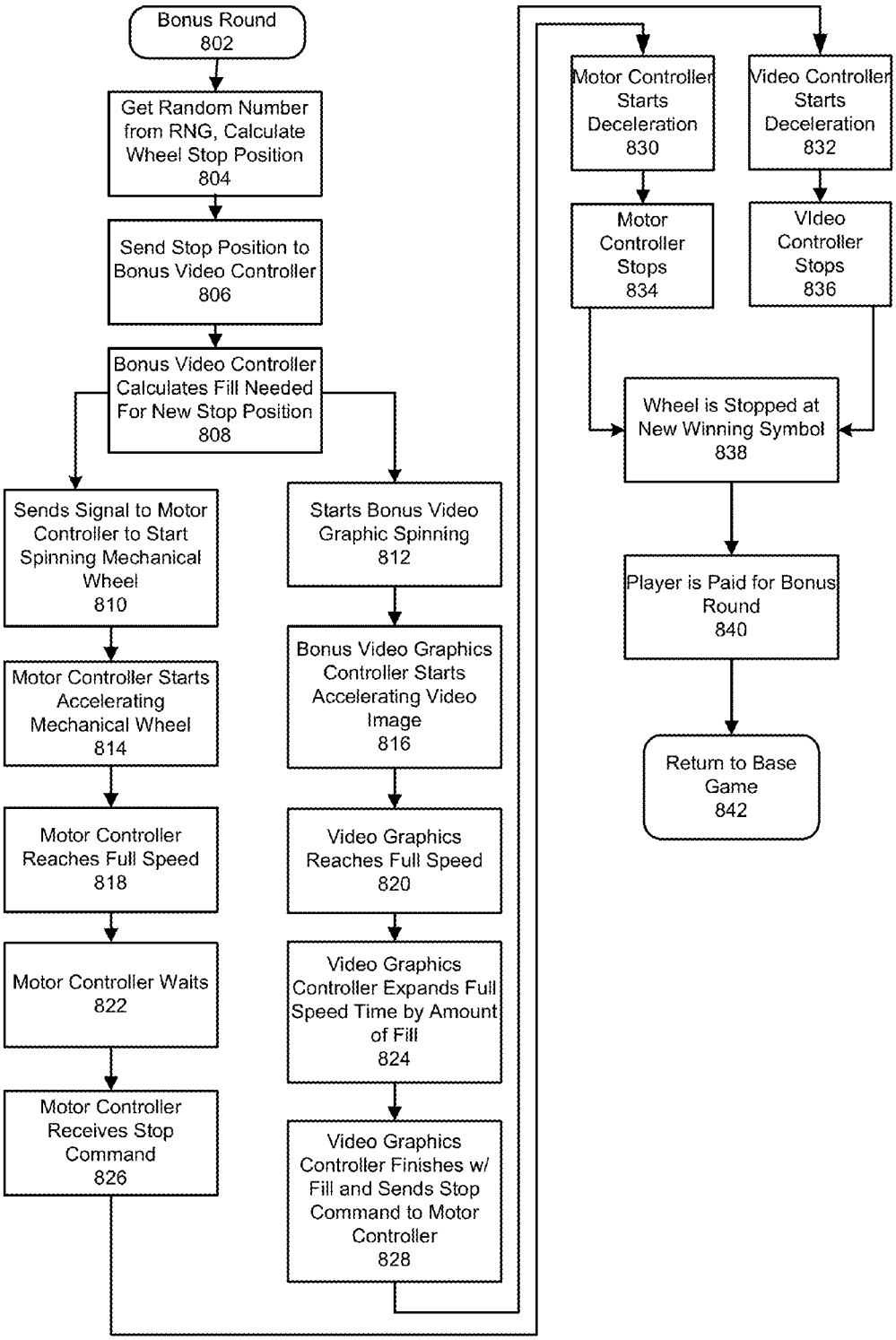
FIG. 13 shows operation of a bonus round on a gaming machine.

FIG. 13 shows a base game, video controller and motor controller, where the video controller and motor controller are part of a bonus game (bonus video controller, bonus motor controller). In step 802, the main game enters a bonus round. The main processor gets a random number from a random number generator and calculates the new stop position of the bonus wheel in step 804. The bonus wheel stop position is passed to the bonus video graphics controller in step 806. The bonus video graphics controller now calculates the amount of fill needed 808. Next, the bonus video graphics controller starts the bonus video graphics spinning in step 812 and at the same time sends a signal to the bonus motor controller to start spinning the mechanical wheel 810. The bonus video graphics controller starts accelerating the video image per the acceleration table 816. At the same time, the bonus motor controller starts accelerating the mechanical wheel. The video graphics reaches full speed in step 820 and at the same time the mechanical wheel has reached full speed in step 818. The bonus video graphics controller continues for the calculated time needed at cruise speed. In step 828, the bonus video graphics controller finishes the cruise speed portion and sends a stop command to the bonus motor controller. The bonus motor controller receives the stop command 826 and starts decelerating according to the deceleration table 830. At the same time, the video graphics controller starts decelerating the video graphics per its deceleration table 832. In step 836, the bonus video graphics controller is stopped and at the same time the bonus motor controller stops the bonus drive motor in step 834. In step 838, the mechanical wheel and video graphics are both stopped. The bonus round is evaluated 840 and the player is credited with any winning. In step 842, the process returns back to the base game.

In another embodiment, instead of controlling the rotating object and the video display image to try to maintain similar profiles, some system of direct feedback is used. For example, the position of the rotating image may be monitored and the rotating object may be controlled to synchronize to the image. Thus, a master-slave relationship is established with one component tracking the other. Generally, the video image is used as the master, with the rotating object being the slave that is controlled to follow the master.

According to specific embodiments, a variety of different sensing mechanisms may be used for measuring and/or detecting motion-related characteristics (e.g., velocity, position, acceleration, deceleration, etc.) of the rotating object. Examples of such sensing mechanisms may include, but are not limited to, one or more of the following (or combination thereof): sensors, transducers, lasers, cameras, etc.

According to specific embodiments, an Image/Motion Synchronization module (either in the motor controller, in the video controller, or in a separate controller) may be operable to utilize a portion of the display motion data (e.g., generated by the sensor) to coordinate the display of content (e.g., images, objects, graphics, text, symbols, etc.) and the rotation of the rotating object. In at least one implementation, such coordinating may include, for example, dynamically and automatically manipulating (e.g., rotating) an image on the display so that the resulting is coordinated and/or synchronized with the movement of the rotating object. For example, in one embodiment, the Image/Motion Synchronization module may be operable to rotate the content to be projected at a rate which substantially matches the rotational velocity of the rotating object. In another embodiment, the Image/Motion Synchronization module may be operable to manipulate the content to be projected so that the relative rotational orientation of the image (e.g., at time T1) substantially matches the relative rotational orientation of the rotating object. In this way, the image and the rotating object retain a particular alignment as they both rotate and appear to be a single rotating object.

In at least one embodiment, the Image/Motion Synchronization module may utilize a combination of techniques for synchronizing the image with movement of the rotating object. For example, in one embodiment, the Image/Motion Synchronization module may rotate the image at a rate which substantially matches the current or real-time rotational velocity of the rotating object. Additionally, at periodic intervals, the Image/Motion Synchronization module may determine a current or real-time position or orientation of the rotating object, and, if necessary, may dynamically and automatically adjusts the relative orientation of the image to be substantially aligned with the rotational position/orientation of the display device. Such a feature may help to reduce possible "drifting" effects where the image drifts out of synchronization from the movement of the rotating object, for example, due to acceleration/deceleration of the rotating object.

It will be appreciated, however, that at least some situations may arise in which it is desirable to not synchronize the image with movement of the rotating object. For example, during a "spin" of a virtual mechanical bonus wheel, it may be desirable to display "blurred" images of a rotating wheel while the movable object is rotating at a fixed high speed. Accordingly, in at least some of such situations, the functionality of the Image/Motion Synchronization module may be wholly or partially disabled. Alternatively, in at least some embodiments, the Image/Motion Synchronization module may be operable to synchronize a first portion of an image with the movement of the rotating object, while allowing a second portion the image to not be synchronized with the movement of the rotating object.

In at least one other embodiment, a non-movable display device may be provided, and content may be displayed on the non-movable display device in a manner which visually simulates a rotating mechanical wheel or sphere.

In one embodiment, hardware and/or software components may be used to coordinate the projected content with the movements of the rotating object.

According to one embodiment, it may be desirable to hide or minimize the viewable portions of the motion control device from the player and/or spectators. For example, the motion control devices associated with a rotating object may be located within the body of a top box. Alternatively, the motion control devices may be displayed to the player and either themed into the game itself, or camouflaged to the extent possible to minimize its visual intrusion. In addition to hiding the motion control devices, it may be desirable at times to also utilize the movable display for different purposes at different times.

According to specific embodiments, the motion control devices may be configured or designed to provide linear and/or non-linear motion to the movable object. Additionally the motion control devices may be configured or designed to translate the rotating object in one, two, or three dimensions.

Figure 14A:
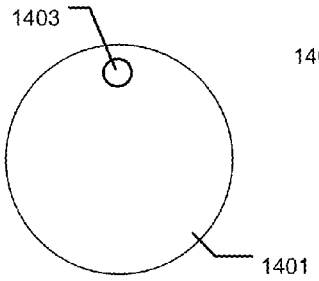
FIG. 14A shows a circular image that is presented on a display.
Figure 14B:
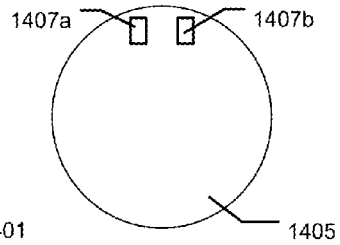
FIG. 14B shows a disc-shaped rotating object with sensors.
Figure 14C:
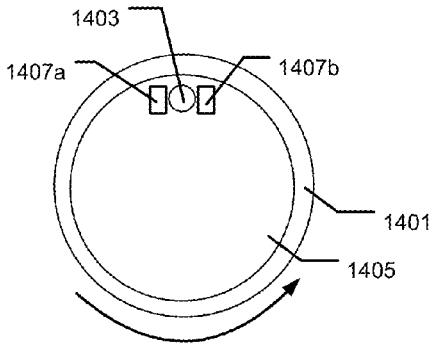
FIG. 14C shows the rotating object of FIG. 14B in front of the circular image of FIG. 14A.

According to another embodiment, an image on a display includes a position indicator that is used to align a rotating object with the image and maintain alignment as both the image and the rotating object rotate. FIG. 14A shows a circular image 1401 that is presented on a display. The circular image includes a position indicator 1403 that may be any suitable visual indicator such as a bright spot. In some examples, the position indicator is outside the portion of the image that is visible to a player (e.g. it is in a peripheral area that is masked by a frame or housing). The position indicator 1403 generally keeps a fixed location with respect to the image on the display, which means that the position indicator moves with the image. For example, where the image rotates, the position indicator rotates with the image. FIG. 14B shows a disc-shaped rotating object 1405 that includes two sensors 1407*a*, 1407*b*. The sensors are light-sensitive sensors that are chosen to provide sensitivity to the bright spot. Thus, the sensors 1407*a*, 1407*b* give a significant change in output when the bright spot moves towards them or away. FIG. 14C shows the rotating object 1405 in front of the image 1401, with the locations of the bright spot 1403 and sensors 1407*a*, 1407*b* indicated. The direction of rotation of both the image and the rotating object is shown.

Both the image 1401 and the rotating object 1405 rotate at the same speed in this example and the sensors are used to provide feedback to maintain synchronization between them. In particular, when the bright spot is located between the sensors as shown, the signals from the sensors are equal. If the rotating object starts to fall behind the image, then the leading sensor 1407*a* (sensor that further ahead in the direction of rotation) provides a stronger signal because the bright spot 1403 is closer to it. The trailing sensor 1407*b* (sensor that is behind) provides a correspondingly weaker signal because the bright spot 1403 is farther from it.

Figure 15:
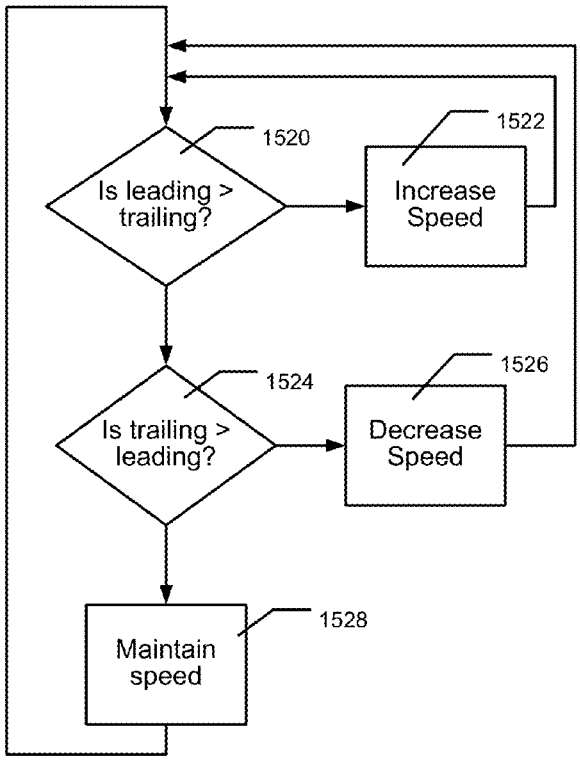
FIG. 15 is a flowchart for a synchronization process.

FIG. 15 shows a process for maintaining synchronization between the image and the rotating object according to an example. If the leading sensor signal is stronger than the trailing sensor 1520, the speed of the rotating object is increased 1522. If the trailing sensor signal is stronger than the leading sensor 1524, then the speed of the rotating object is decreased 1526. Otherwise the speed is maintained 1528. In this way, the speed of the rotating object is constantly adjusted to match that of the image. If the rotation speed of the image changes, the rotation speed of the rotating object is changed to match it.

While the above examples disclose various spinning disc examples of rotating objects, other shapes may also be used and the axis of rotation is not limited to a horizontal axis.

Figure 16:
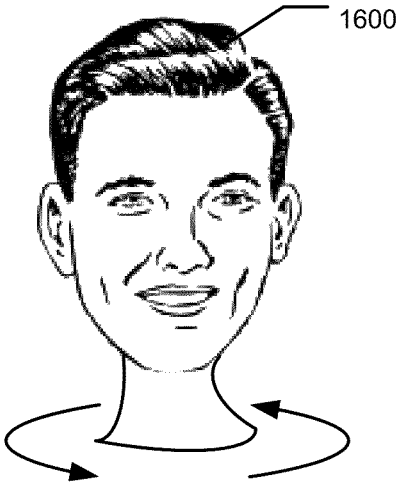
FIG. 16 shows a rotating object that is shaped like a human head.

Rotating objects may have various different shapes in order to present different content to a player. For example, FIG. 16 shows a rotating object 1600 that is shaped like a human head. The object may act as a display either through projection or through active electronic elements on the surface of the object, or some combination of projection and active electronic elements. This may allow different effects to be produced by electronic means. For example, using a generic head shape and different display images, different faces may be reproduced. Also, the displayed image may be made to simulate movement of parts of a person's face (e.g. movement of the lips to simulate speech, or blinking of the eyes). The object may have one or more degrees of freedom. For example, the object may be rotated about a vertical axis and may also be capable of moving vertically so that it can be brought into position in front of a display or moved back away from the display. When the object is rotated, it may be rotated in a manner that is synchronized with an image on a display. For example, the object may rotate at the same speed as a rotating image on an adjacent display. The displayed image may be modified while the object is rotating. In some cases the image is modified when the game is changed. Thus, the object may resemble a particular celebrity for a particular game and may be reconfigured (through software) to resemble a different celebrity for a different game. This provides easy reconfiguration of a three-dimensional object.

Figure 17:
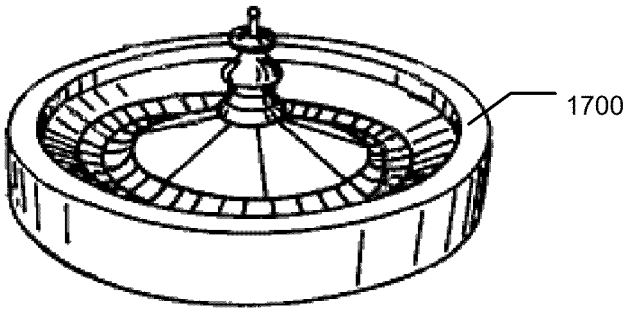
FIG. 17 shows a rotating object that is shaped like a roulette wheel.

FIG. 17 shows another example of a rotating object. The rotating object 1700 is shaped like a roulette wheel and rotates about an axis through the center of the roulette wheel. The rotating object has at least some surfaces that act as displays, either through projection or using active electronic elements. An image displayed on the rotating object may be modified while the object is rotated. For example, an image of a ball may be introduced to simulate a roulette ball. The image of the ball eventually stops in one sector of the roulette wheel to indicate a game result. Such a roulette wheel gives a convincing impression of a real wheel because the primary component is a physically rotating wheel, but the game is also electronically configurable so that the result of the game may be generated electronically (e.g. using a random number generator) and the look of the game may be modified easily through software and does not require physically changing components. Rotating objects of different shapes may also be provided including hemispherical, pyramid, diamond shaped and the like.

While active electronic elements may be used in the above embodiments, projection may also be used to produce an image on a surface. US Patent Application Publication No. 2007/0149281 provides examples of projection apparatus and methods of using such apparatus in gaming machines. In one embodiment, the projection engine may, for example, include a Digital Light Processing (DLP) engine. As such, any DLP projection content may be used for projection of images/objects on the surface of the projection surface. DLP technology is generally known to those skilled in the art. It should be noted that other projection technologies may be used. One such technology is generally known as LCos (Liquid Crystal on silicon) which can effectively create images/objects using a stationary mirror mounted on the surface of a chip and using a liquid crystal matrix to control how much light is reflected.

Additionally, in at least some embodiments, "pixel-warping" may be utilized to achieve a desired display effect using, for example, a conventional convex-type lens. In one embodiment, pixel-warping may be achieved by digitally manipulating pixels, for example, by using a Silicon Optics Pixel Warping chip (available from Silicon Optics www.siliconoptix.com). Thus, an image may be projected on a display with a non-planar surface such as a head-shape or roulette wheel shape.

According to various embodiments, one or more of the rotatable active electronic display devices described herein may be utilized in a variety of systems such as, for example, one or more of the following (or combinations thereof): single-player gaming machines, multi-player gaming systems, tournament game play systems, entertainment systems, promotion systems, bonus game play systems, player tracking systems, security systems, etc. In at least some embodiments, the movable virtual mechanical display device may be automatically and/or dynamically configurable (e.g., in real-time) in order to allow the movable virtual mechanical display device to be used in conjunction with a variety of different gaming and/or non-gaming related activities such as, for example: game play activities, tournament play activities, promotional activities, bonus activities, attraction activities, etc.

In one example, a base game is played on a stand-alone gaming machine, with a bonus game played on a top-box that includes a wheel according to one of the examples above. The base game may be poker, roulette, keno, blackjack, or the like. The bonus game may be played on a bonus module located within the top box of the stand-alone gaming machine and may be constructed of a semi-transparent or transparent mechanical device that is driven by a stepper motor, DC electric motor, AC electric motor or the like. In addition, a video display such as an LCD, CRT, plasma, rear projection system, or the like may be located behind the mechanical device. The player may be requested by the bonus game to "Spin the Wheel" of the bonus device. This input may be from a "Spin Button" that may be located on the base game's "Player Panel," a handle located on the side of the stand-alone gaming machine or a "Programmable Video Button" located on the video graphics display of the base game.

The video graphics display of the bonus game may display a representation of a spinning wheel bonus much like the "IGT Wheel of Fortune" game or the like. The mechanical device may initially be stationary (non-rotating). The player then presses the "Spin Button" to activate or start the bonus game. This action places the bonus game into play. It will be appreciated that many variations may be used to activate the bonus game. One example may be the pulling of the handle located on the side of the stand-alone gaming machine. Another example may be pressing of buttons (either physical or virtual) located on the surface of the stand-alone gaming machine. Another example may be a bonus activated by an event from another stand-alone gaming machine or a server-linked gaming controller.

The stand-alone gaming machine CPU may produce a random outcome for the conclusion of the bonus game. This random outcome will be associated with a stop position on the video graphics display of the bonus game. In another aspect of the present invention, the random outcome for the bonus game may be produced by a server-linked gaming controller.

Other System Embodiments

Figure 18:
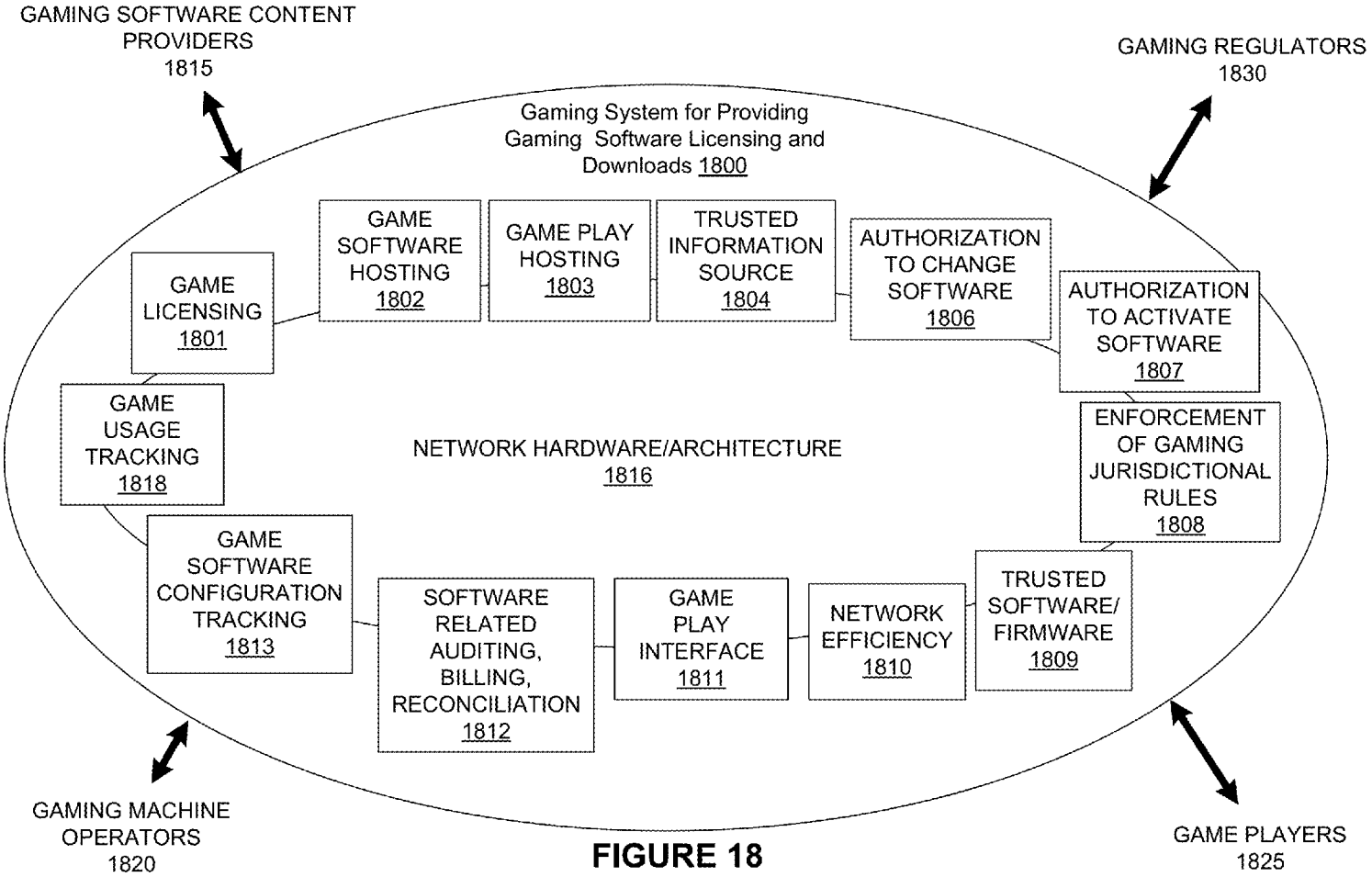
FIG. 18 is a block diagram of an example of a gaming network in accordance with a specific embodiment.

FIG. 18 shows a block diagram illustrating components of a gaming system 1800 which may be used for implementing various aspects of example embodiments. In FIG. 18, the components of a gaming system 1800 for providing game software licensing and downloads are described functionally. The described functions may be instantiated in hardware, firmware and/or software and executed on a suitable device. In the system 1800, there may be many instances of the same function, such as multiple game play interfaces 1811. Nevertheless, in FIG. 18, only one instance of each function is shown. The functions of the components may be combined. For example, a single device may comprise the game play interface 1811 and include trusted memory devices or sources 1809.

The gaming system 1800 may receive inputs from different groups/entities and output various services and or information to these groups/entities. For example, game players 1825 primarily input cash or indicia of credit into the system, make game selections that trigger software downloads, and receive entertainment in exchange for their inputs. Game software content providers provide game software for the system and may receive compensation for the content they provide based on licensing agreements with the gaming machine operators. Gaming machine operators select game software for distribution, distribute the game software on the gaming devices in the system 1800, receive revenue for the use of their software and compensate the gaming machine operators. The gaming regulators 1830 may provide rules and regulations that must be applied to the gaming system and may receive reports and other information confirming that rules are being obeyed.

In the following paragraphs, details of each component and some of the interactions between the components are described with respect to FIG. 18. The game software license host 1801 may be a server connected to a number of remote gaming devices that provides licensing services to the remote gaming devices. For example, in other embodiments, the license host 1801 may 1) receive token requests for tokens used to activate software executed on the remote gaming devices, 2) send tokens to the remote gaming devices, 3) track token usage and 4) grant and/or renew software licenses for software executed on the remote gaming devices. The token usage may be used in utility based licensing schemes, such as a pay-per-use scheme.

In another embodiment, a game usage-tracking host 1815 may track the usage of game software on a plurality of devices in communication with the host. The game usage-tracking host 1815 may be in communication with a plurality of game play hosts and gaming machines. From the game play hosts and gaming machines, the game usage tracking host 1815 may receive updates of an amount that each game available for play on the devices has been played and on amount that has been wagered per game. This information may be stored in a database and used for billing according to methods described in a utility based licensing agreement.

The game software host 1802 may provide game software downloads, such as downloads of game software or game firmware, to various devious in the game system 1800. For example, when the software to generate the game is not available on the game play interface 1811, the game software host 1802 may download software to generate a selected game of chance played on the game play interface. Further, the game software host 1802 may download new game content to a plurality of gaming machines via a request from a gaming machine operator.

In one embodiment, the game software host 1802 may also be a game software configuration-tracking host 1813. The function of the game software configuration-tracking host is to keep records of software configurations and/or hardware configurations for a plurality of devices in communication with the host (e.g., denominations, number of paylines, paytables, max/min bets). Details of a game software host and a game software configuration host that may be used with example embodiments are described in co-pending U.S. Pat. No. 6,645,077, by Rowe, entitled, "Gaming Terminal Data Repository and Information System," filed Dec. 21, 2000, which is incorporated herein in its entirety and for all purposes.

A game play host device 1803 may be a host server connected to a plurality of remote clients that generates games of chance that are displayed on a plurality of remote game play interfaces 1811. For example, the game play host device 1803 may be a server that provides central determination for a bingo game play played on a plurality of connected game play interfaces 1811. As another example, the game play host device 1803 may generate games of chance, such as slot games or video card games, for display on a remote client. A game player using the remote client may be able to select from a number of games that are provided on the client by the host device 1803. The game play host device 1803 may receive game software management services, such as receiving downloads of new game software, from the game software host 1802 and may receive game software licensing services, such as the granting or renewing of software licenses for software executed on the device 1803, from the game license host 1801.

In particular embodiments, the game play interfaces or other gaming devices in the gaming system 1800 may be portable devices, such as electronic tokens, cell phones, smart cards, tablet PC's and PDA's. The portable devices may support wireless communications and thus, may be referred to as wireless mobile devices. The network hardware architecture 1816 may be enabled to support communications between wireless mobile devices and other gaming devices in gaming system. In one embodiment, the wireless mobile devices may be used to play games of chance.

The gaming system 1800 may use a number of trusted information sources. Trusted information sources 1804 may be devices, such as servers, that provide information used to authenticate/activate other pieces of information. CRC values used to authenticate software, license tokens used to allow the use of software or product activation codes used to activate to software are examples of trusted information that might be provided from a trusted information source 1804. Trusted information sources may be a memory device, such as an EPROM, that includes trusted information used to authenticate other information. For example, a game play interface 1811 may store a private encryption key in a trusted memory device that is used in a private key-public key encryption scheme to authenticate information from another gaming device.

When a trusted information source 1804 is in communication with a remote device via a network, the remote device will employ a verification scheme to verify the identity of the trusted information source. For example, the trusted information source and the remote device may exchange information using public and private encryption keys to verify each other's identities. In another example of an embodiment, the remote device and the trusted information source may engage in methods using zero knowledge proofs to authenticate each of their respective identities. Details of zero knowledge proofs that may be used with example embodiments are described in US publication no. 2003/0203756, by Jackson, filed on Apr. 25, 2002 and entitled, "Authentication in a Secure Computerized Gaming System, which is incorporated herein in its entirety and for all purposes.

Gaming devices storing trusted information might utilize apparatus or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected.

The gaming system 1800 of example embodiments may include devices 1806 that provide authorization to download software from a first device to a second device and devices 1807 that provide activation codes or information that allow downloaded software to be activated. The devices, 1806 and 1807, may be remote servers and may also be trusted information sources. One example of a method of providing product activation codes that may be used with example embodiments is describes in previously incorporated U.S. Pat. No. 6,264,561.

A device 1806 that monitors a plurality of gaming devices to determine adherence of the devices to gaming jurisdictional rules 1808 may be included in the system 1800. In one embodiment, a gaming jurisdictional rule server may scan software and the configurations of the software on a number of gaming devices in communication with the gaming rule server to determine whether the software on the gaming devices is valid for use in the gaming jurisdiction where the gaming device is located. For example, the gaming rule server may request a digital signature, such as CRC's, of particular software components and compare them with an approved digital signature value stored on the gaming jurisdictional rule server.

Further, the gaming jurisdictional rule server may scan the remote gaming device to determine whether the software is configured in a manner that is acceptable to the gaming jurisdiction where the gaming device is located. For example, a maximum bet limit may vary from jurisdiction to jurisdiction and the rule enforcement server may scan a gaming device to determine its current software configuration and its location and then compare the configuration on the gaming device with approved parameters for its location.

A gaming jurisdiction may include rules that describe how game software may be downloaded and licensed. The gaming jurisdictional rule server may scan download transaction records and licensing records on a gaming device to determine whether the download and licensing was carried out in a manner that is acceptable to the gaming jurisdiction in which the gaming device is located. In general, the game jurisdictional rule server may be utilized to confirm compliance to any gaming rules passed by a gaming jurisdiction when the information needed to determine rule compliance is remotely accessible to the server.

Game software, firmware or hardware residing a particular gaming device may also be used to check for compliance with local gaming jurisdictional rules. In one embodiment, when a gaming device is installed in a particular gaming jurisdiction, a software program including jurisdiction rule information may be downloaded to a secure memory location on a gaming machine or the jurisdiction rule information may be downloaded as data and utilized by a program on the gaming machine. The software program and/or jurisdiction rule information may used to check the gaming device software and software configurations for compliance with local gaming jurisdictional rules. In another embodiment, the software program for ensuring compliance and jurisdictional information may be installed in the gaming machine prior to its shipping, such as at the factory where the gaming machine is manufactured.

The gaming devices in game system 1800 may utilize trusted software and/or trusted firmware. Trusted firmware/software is trusted in the sense that is used with the assumption that it has not been tampered with. For instance, trusted software/firmware may be used to authenticate other game software or processes executing on a gaming device. As an example, trusted encryption programs and authentication programs may be stored on an EPROM on the gaming machine or encoded into a specialized encryption chip. As another example, trusted game software, i.e., game software approved for use on gaming devices by a local gaming jurisdiction may be required on gaming devices on the gaming machine.

In example embodiments, the devices may be connected by a network 1816 with different types of hardware using different hardware architectures. Game software can be quite large and frequent downloads can place a significant burden on a network, which may slow information transfer speeds on the network. For game-on-demand services that require frequent downloads of game software in a network, efficient downloading is essential for the service to viable. Thus, in example embodiments, network efficient devices 1810 may be used to actively monitor and maintain network efficiency. For instance, software locators may be used to locate nearby locations of game software for peer-to-peer transfers of game software. In another example, network traffic may be monitored and downloads may be actively rerouted to maintain network efficiency.

One or more devices in example embodiments may provide game software and game licensing related auditing, billing and reconciliation reports to server 1812. For example, a software licensing billing server may generate a bill for a gaming device operator based upon a usage of games over a time period on the gaming devices owned by the operator. In another example, a software auditing server may provide reports on game software downloads to various gaming devices in the gaming system 1800 and current configurations of the game software on these gaming devices.

At particular time intervals, the software auditing server 1812 may also request software configurations from a number of gaming devices in the gaming system. The server may then reconcile the software configuration on each gaming device. In one embodiment, the software auditing server 1812 may store a record of software configurations on each gaming device at particular times and a record of software download transactions that have occurred on the device. By applying each of the recorded game software download transactions since a selected time to the software configuration recorded at the selected time, a software configuration is obtained. The software auditing server may compare the software configuration derived from applying these transactions on a gaming device with a current software configuration obtained from the gaming device. After the comparison, the software-auditing server may generate a reconciliation report that confirms that the download transaction records are consistent with the current software configuration on the device. The report may also identify any inconsistencies. In another embodiment, both the gaming device and the software auditing server may store a record of the download transactions that have occurred on the gaming device and the software auditing server may reconcile these records.

There are many possible interactions between the components described with respect to FIG. 18. Many of the interactions are coupled. For example, methods used for game licensing may affect methods used for game downloading and vice versa. For the purposes of explanation, details of a few possible interactions between the components of the system 1800 relating to software licensing and software downloads have been described. The descriptions are selected to illustrate particular interactions in the game system 1800. These descriptions are provided for the purposes of explanation only and are not intended to limit the scope of example embodiments described herein.

Figure 19:
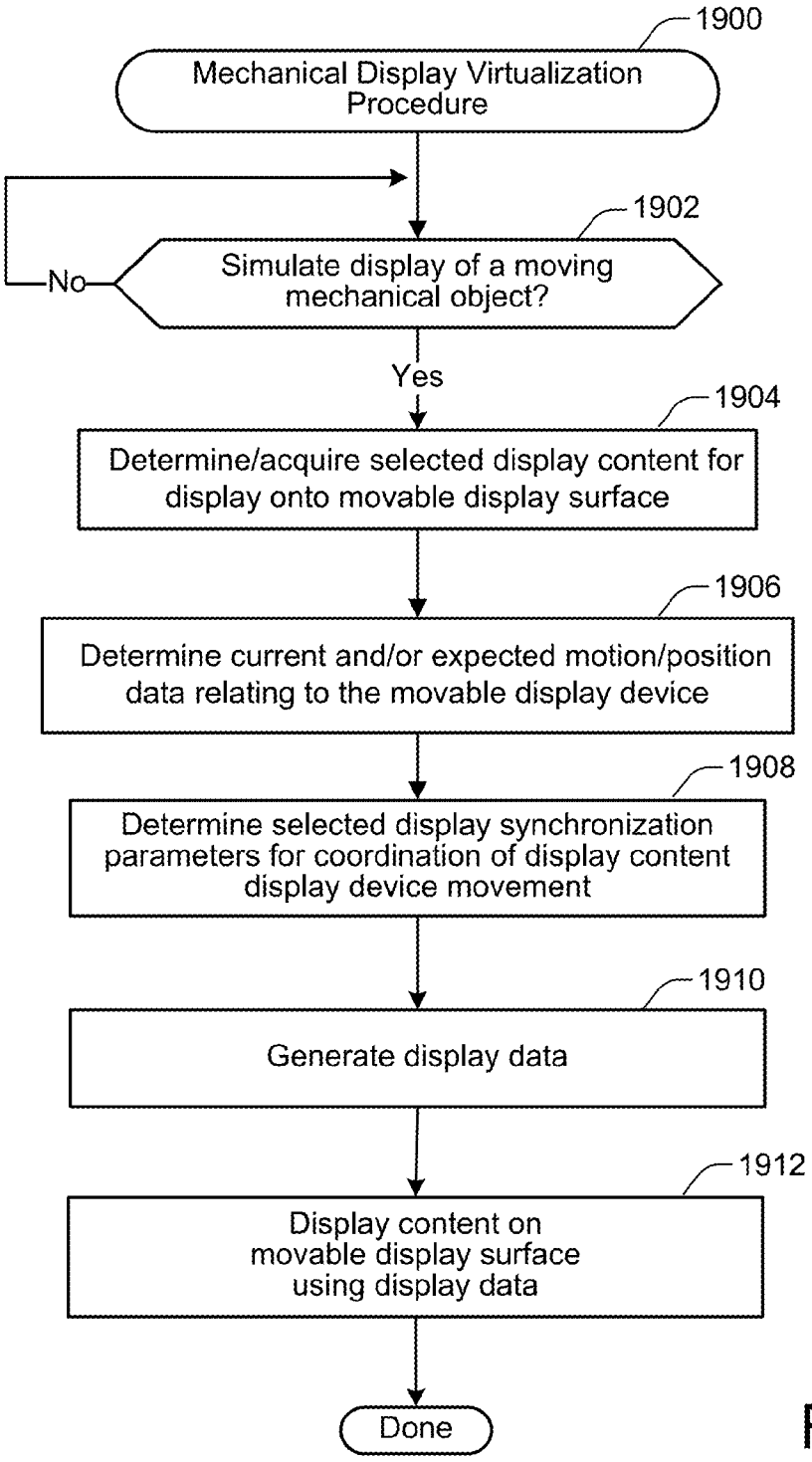
FIG. 19 shows a flow diagram of a Mechanical Display Virtualization Procedure 1900 in accordance with a specific embodiment

FIG. 19 shows a flow diagram of a Mechanical Display Virtualization Procedure 1900 in accordance with a specific embodiment. In at least one embodiment, the Mechanical Display Virtualization Procedure may be utilized to facilitate coordination of displayed content and movement of the movable display. According to specific embodiments, at least some portions of the Mechanical Display Virtualization Procedure 1900 may be implemented at one or more devices/components of a gaming machine and/or at other devices/systems of the casino network.

For purposes of illustration, the Mechanical Display Virtualization Procedure of FIG. 19 will be described by way of example with reference to gaming machine 150 of FIG. 1B. In this example the Mechanical Display Virtualization Procedure may be implemented at gaming machine 150 which is operable to conduct wagering and/or game play activities involving display of a plurality of images. Conventionally, at least a portion of such images would be affixed to a mechanical wheel configured to rotate during game play and/or bonus play.

At 1902 it is assumed that at least one event has been detected for initiating a simulated display of a moving mechanical (or physical) object. In this particular example it is assumed that at least one event has been detected for initiating a simulated display of a moving wheel using the movable display device 145 of FIG. 1B, which is the movable object of this example. In at least one embodiment, a variety of different predetermined events and/or conditions may trigger activation of the moving virtual mechanical wheel of FIG. 1B.

At 1904, at least one operation may be initiated for determining and/or acquiring selected display content to be displayed on the movable display device. In at least one embodiment, at least a portion of the display content may be dynamically selected based on the event(s) which triggered activation of the moving virtual mechanical wheel. According to specific embodiments, at least a portion of the selected display content may be displayed on the movable display device (e.g., 145), and may include, for example: images, objects, graphics, text, symbols, etc. According to specific embodiments, at least some of the selected display content may be downloaded from a server to the gaming machine and/or retrieved from a local storage at the gaming machine.

At 1906, at least one operation may be initiated for determining current and/or expected motion/position data relating to the movable object that has active electronic display elements. According to specific embodiments, the motion/position data may include display motion data (e.g., described previously with respect to FIG. 2B) which, for example, may describe current (e.g., real-time), past and/or future motion-related characteristics of the movable display device. Examples of different types of motion-related characteristics may include, but are not limited to: directional vector data, velocity data, displacement data, orientation data, position data, acceleration data, deceleration data, etc.

At 1908, at least one operation may be initiated for determining selected display synchronization parameters for coordination of display content and display device movement. For example, in one embodiment, display synchronization parameters may be generated for causing the displayed content on a fixed display to be rotated at a rate which substantially matches a current or real-time rotational velocity of the movable object. Additionally, or alternatively, display synchronization parameters may be generated for causing the orientation of the displayed content to be adjusted (e.g., in real-time) so that, when displayed, the orientation of the displayed content is substantially aligned with the current rotational position/orientation of the object, in accordance with specified alignment criteria.

As shown at 1910, display data may be generated for the active electronic display. In at least one embodiment, the display data may be generated (e.g., in real-time, or in advance) using selected portions of the display synchronization parameters and display content. Further, in at least one embodiment, the display data may include content (e.g., images, objects, graphics, text, symbols, indicia, etc.) which has been specifically manipulated for display on the movable display surface. For example, in a specific embodiment, the display data, which is to be displayed by active electronic elements on the movable display surface, may include content which has been specifically manipulated to resemble a rotating mechanical wheel such as, for example, the mechanical bonus wheel of the well known Wheel of Fortune™ gaming machine. In some embodiments, the display data may also include timing data relating to various timing parameters which may be used, for example, to synchronize display of content with the movement of the movable display device.

As shown at 1912, desired content may be displayed on the surface of the movable display device using at least a portion of the display data.

Figure 20:
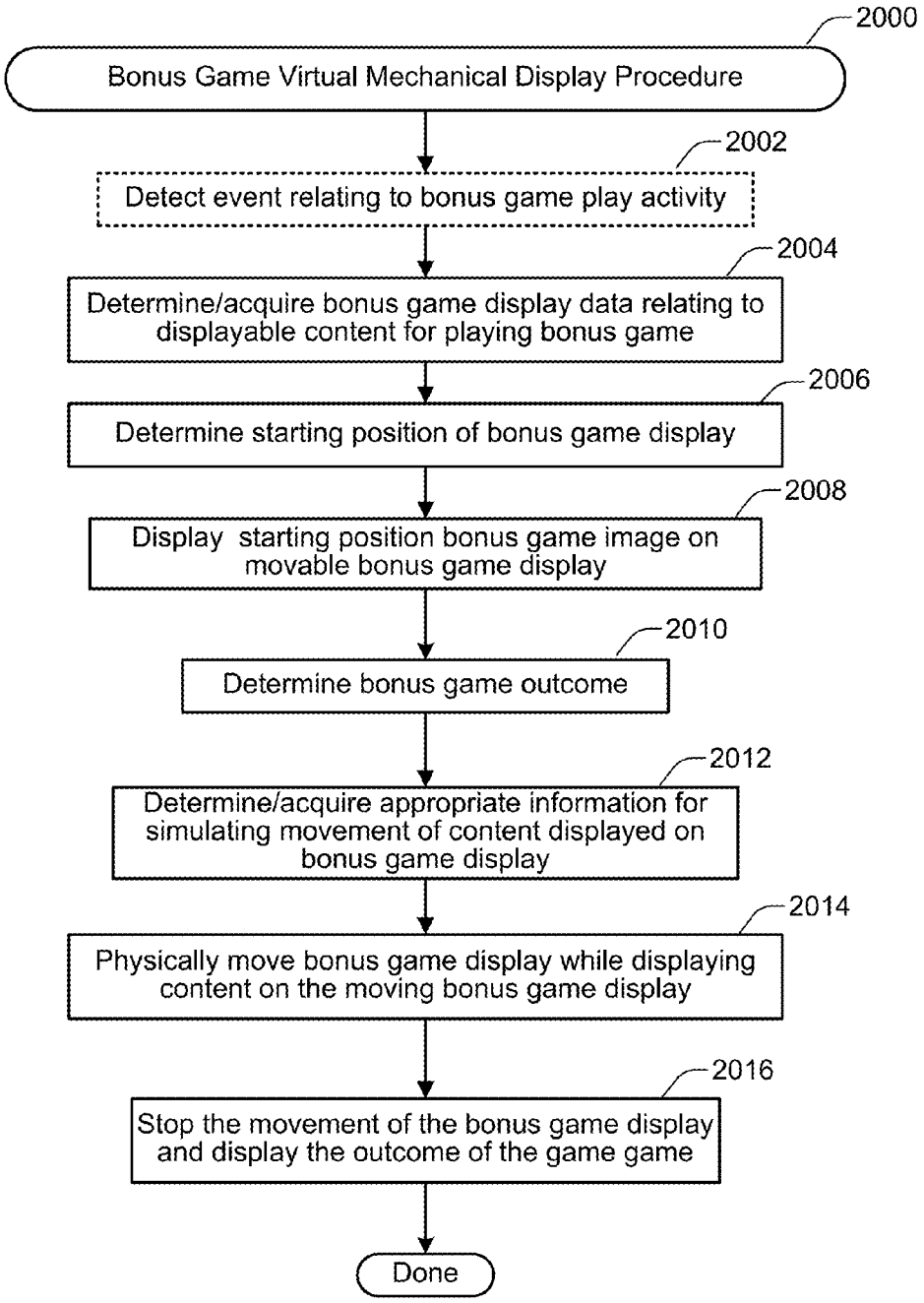
FIG. 20 shows a flow diagram of a Bonus Game Virtual Mechanical Display Procedure 2000 in accordance with a specific embodiment

FIG. 20 shows a flow diagram of a Bonus Game Virtual Mechanical Display Procedure 2000 in accordance with a specific embodiment. It will be appreciated that the Bonus Game Virtual Mechanical Display Procedure 2000 of FIG. 20 is intended to provide an example of a specific embodiment illustrating how the virtual movable mechanical display techniques of the present invention may be applied to bonus game activities conducted at a gaming machine.

For purposes of illustration, the Bonus Game Virtual Mechanical Display Procedure 2000 will be described by way of example with reference to gaming machine 150 of FIG. 1B.

As shown at 2002, it is assumed that at least one event and/or condition has been detected for initiating bonus game play activity at the gaming machine.

At 2004, at least one operation is performed for determining and/or acquiring bonus game display data relating to displayable content (e.g., images, objects, graphics, text, symbols, indicia, etc.) for playing a bonus game. In at least one embodiment, at least a portion of the displayable content may be dynamically selected based on the event(s) and/or conditions which triggered initiation of the bonus game activity. According to specific embodiments, at least some of the selected displayable content may be downloaded from a server to the gaming machine and/or retrieved from a local storage at the gaming machine.

At 2006 a current starting position of the bonus game display is determined. In one embodiment, the current starting position of the bonus game display may be automatically and dynamically selected based upon specified criteria. In other embodiments, the current starting position of the bonus game display has been predetermined based upon previous activities occurring at the gaming machine. For example, in one embodiment, the current starting position of the bonus game display may correspond to the ending or resting position of the bonus game display which occurred at the end of the most recent, previously played bonus game. In at least some embodiments (such as, for example, when specific content is continuously displayed on the movable bonus display device, even at times when no bonus game activity is occurring) the starting position of the bonus game display may correspond to the current relative position or orientation of the bonus game display, as can be observed by a player at the gaming machine.

As shown at 2008, when appropriate, the starting position bonus game image may be displayed on the movable bonus game display. It will be appreciated that this operation may be omitted in at least some embodiments such as, for example, where the starting position bonus game image is already being displayed at the movable bonus game display.

At 2010, an outcome for the bonus game is determined, received and/or obtained. According to specific embodiments, the outcome of the bonus game can, for example, be determined by the gaming machine and/or by a server machine. In one embodiment, a random number generator may be used to determine the bonus game outcome.

At 2012, at least one operation is performed to determine and/or acquire appropriate information for simulating movement(s) of content displayed on the bonus game display. As noted previously, examples of such movements may include rotational movements and/or linear movements. According to specific embodiments, at least a portion of such information can, for example, be determined by a server and/or the gaming machine. In one embodiment, the determined/acquired information may be based, at least partially, on a predetermined outcome of the bonus game. In one embodiment, such information may include and/or effectively represent one or more objects, text, symbols, etc to be displayed for the outcome.

As shown at 2014, the movable bonus game display may be physically moved while content is displayed on the moving bonus game display. In specific embodiments where the bonus game display is intended to simulate the "look and feel" of a rotating mechanical bonus wheel, the movable bonus game display may be mechanically rotated while content is displayed on the surface of the rotating display to provide the visual effect of mechanical wheel that is rotating. Thus, in at least some embodiments, the rotation of the bonus game display is coordinated with the displayed images to give the appearance of a rotating mechanical wheel having static content imprinted thereon and/or affixed thereto.

At 2016, the movement (e.g., rotation) of the bonus game display is stopped, and the bonus game outcome is effectively displayed on the bonus game display. In at least some embodiments where the bonus game outcome has been predetermined, the movement (e.g., rotation) of the bonus game display and displayed content may be coordinated such that the final resting position of the virtual mechanical bonus game display corresponds to the predetermined bonus game outcome. In at least one embodiment, after the bonus game outcome has been displayed, the player may be awarded with award such as, for example, credits, points, jackpot prize, etc.

Techniques and mechanisms of embodiments described herein may sometimes be described in singular form for clarity. However, it should be noted that particular embodiments include multiple iterations of a technique or multiple instantiations of a mechanism unless noted otherwise.

Although several preferred embodiments of this invention have been described in detail herein with reference to the accompanying drawings, it is to be understood that the invention is not limited to these precise embodiments, and that various changes and modifications may be effected therein by one skilled in the art without departing from the scope of spirit of the invention as defined in the appended claims.

It is claimed:

1. A gaming machine comprising:

a stationary video display configured to present a video of a rotating image, the rotating image rotating about an axis of rotation and having a rotational speed; and a rotating object located in front of the display from a perspective of a player of the gaming machine, the rotating object including a light valve positioned over the rotating image, wherein the light valve is configured to switch between a first mode, in which the light valve obscures the rotating image from the player, and a second mode in which the player can view rotating image through the light valve, wherein the rotating object rotates about the axis of rotation at the rotational speed such that the position of the light valve is synchronized with and remains in front the rotating image.

2. The gaming machine of claim 1 wherein the rotating object is a disk with an axis that is perpendicular to a front surface of the video display.

3. The gaming machine of claim 1, wherein the video display displays a rotating wheel of fortune, the rotating object rotates at the same speed as the displayed wheel of fortune, and the electronically-configurable display obscures a sector of the wheel of fortune.

4. The gaming machine of claim 1 wherein the rotating object is shaped like a human head.

5. The gaming machine of claim 1 wherein the rotating object is shaped like a roulette wheel.

6. The gaming machine of claim 1, wherein the rotating image includes an indicator of angular position and the rotating object has disposed thereon at least one optical sensor for detecting the indicator of angular position.

7. The gaming machine of claim 1, wherein the synchronization circuit synchronizes the rotating object's speed of rotation by controlling the speed of rotation of the rotating object in response to feedback from the at least one optical sensor such that the speed of rotation of the rotating object is matched to the rate of change of the angular position of the indicator.

8. The gaming machine of claim 7, wherein the at least one optical sensor includes a leading sensor and a trailing sensor.

9. The gaming machine of claim 7, wherein the indicator of angular position in the rotating image is a bright spot within the rotating image.

10. The gaming machine of claim 1, wherein the light valve forms a wedge-shape which, in the first mode, obscures a wedge-shaped portion of the rotating image.

11. The gaming machine of claim 1, wherein the light valve has variable translucency.

12. The gaming machine of claim 1, wherein the synchronization circuit synchronizes the rotating object's speed of rotation by rotating the rotating object according to an acceleration profile, the acceleration profile indicating a predetermined angular acceleration; and wherein the rotating image rotated according to the acceleration profile so that the rotating image is accelerated with the predetermined angular acceleration.

13. The gaming machine of claim 12, wherein the acceleration profile is recorded in a lookup table.

14. The gaming machine of claim 13, wherein the rotating object is rotated by a stepper motor according to the lookup table.

15. The gaming machine of claim 1, wherein the synchronization circuit synchronizes the rotating object's speed of rotation by:

rotating the rotating object according to a predetermined pattern;

monitoring the rotating object using an optical encoder to provide a feedback signal; and controlling the video display in response to the feedback signal so that the rotating image appears to rotate with the rotating object.

16. The gaming machine of claim 15, wherein the optical encoder uses a plurality of flags on the rotating object and a plurality of stationary sensors.

17. The gaming machine of claim 15, wherein the predetermined pattern consists of an acceleration portion, a cruising speed portion, and a deceleration portion.

18. The gaming machine of claim 3, wherein the rotating image corresponds to an individual sector of the wheel of fortune, and wherein the light valve has a shape corresponding to the individual sector such that the individual sector is either obscured from the player or presented to the player depending on the mode of the light valve.

* * * * *